US008713864B1

(12) United States Patent
Smith, Jr.

(10) Patent No.: US 8,713,864 B1
(45) Date of Patent: May 6, 2014

(54) SKYLIGHT FOR METAL PANEL ROOF

(71) Applicant: McElroy Metal Mill, Inc., Bossier City, LA (US)

(72) Inventor: Charles L. Smith, Jr., Houston, TX (US)

(73) Assignee: McElroy Metal Mill, Inc., Bossier City, LA (US)

( * ) Notice: Subject to any disclaimer, the term of this patent is extended or adjusted under 35 U.S.C. 154(b) by 0 days.

(21) Appl. No.: 13/694,053

(22) Filed: Oct. 24, 2012

Related U.S. Application Data

(60) Provisional application No. 61/552,853, filed on Oct. 28, 2011.

(51) Int. Cl.
*E04B 7/18* (2006.01)

(52) U.S. Cl.
USPC ..... 52/200; 52/203

(58) Field of Classification Search
USPC ..... 52/200, 203, 204.1
See application file for complete search history.

(56) References Cited

U.S. PATENT DOCUMENTS 4,527,368 A * 7/1985 Jentoft ..... 52/200
4,559,753 A * 12/1985 Brueske ..... 52/748.1
4,575,983 A 3/1986 Lott, Jr. et al.
4,649,684 A 3/1987 Petree et al.
RE32,539 E * 11/1987 Jentoft et al. ..... 52/200
4,703,592 A * 11/1987 Sampson et al. ..... 52/20
4,788,804 A * 12/1988 Haas ..... 52/200
4,860,511 A * 8/1989 Weisner et al. ..... 52/200
4,896,468 A * 1/1990 Sampson et al. ..... 52/200
4,986,039 A * 1/1991 Weisner ..... 52/72
4,987,705 A * 1/1991 Sampson et al. ..... 52/72
5,044,133 A * 9/1991 Sampson et al. ..... 52/72
5,148,643 A * 9/1992 Sampson et al. ..... 52/200
5,323,576 A * 6/1994 Gumpert et al. ..... 52/200
5,367,848 A 11/1994 McConnohie
5,737,892 A 4/1998 Greenberg
6,354,045 B1 3/2002 Boone et al.
6,775,951 B2 8/2004 Gumpert et al.
6,796,097 B2 9/2004 Fensel et al.
7,296,388 B2 * 11/2007 Valentz et al. ..... 52/200
7,631,464 B2 * 12/2009 Valentz et al. ..... 52/200
8,061,087 B2 11/2011 Ray

* cited by examiner

*Primary Examiner* — Basil Katcheves
(74) *Attorney, Agent, or Firm* — Keith B. Willhelm

(57) ABSTRACT

Skylights and roofs having skylights are provided for. The skylights may comprise a pair of elongated struts adapted for mounting vertically on opposing sides of an opening in the roof cover and a translucent panel mounted horizontally across the struts. The translucent panel has upwardly extending sides adapted to be joined to form horizontal seams, and the struts are adapted to support the translucent panel above the roof cover.

35 Claims, 15 Drawing Sheets

SKYLIGHT FOR METAL PANEL ROOF

CLAIM TO PRIORITY

This application claims priority of U.S. provisional application Ser. No. 61/552,853, filed Oct. 28, 2011, the disclosure and drawings of which are incorporated herein in their entirety by reference.

FIELD OF THE INVENTION

The present invention relates to metal panel roof systems and, more particularly, to metal panel roof systems having skylights.

BACKGROUND OF THE INVENTION

There are a wide variety of metal covers that have been used in the construction industry to provide a building's outermost barrier to wind and water. They may be manufactured to resemble wood shake, slate, shingles, clay tiles or other non-metallic cover materials and may be installed on exterior walls or on roofs. More typically, however, metal roof covers utilize rather elongated metal panels installed along the slope of a roof.

Metal panel roofs utilize various flashings and other components where the fields of a roof terminate or intersect, such as the eaves, gables, valleys, ridges, and hips of a roof. Even in roofs having many different intersecting or overlapping fields, however, the basic construction of metal panel roofs across the expanse of a roof is fairly standard. Most commonly, an array of spaced, elongated support members or "purlins" is mounted across the structural rafters of a roof substructure. The purlins run horizontally across the rafters, i.e., across the slope of the roof. Layers of insulation and various barriers may be, and for climate controlled buildings usually are installed as well. Decking also may be provided for additional support. A cover is provided by a series of rather elongated, mostly flat, interconnected metal panels.

Each cover panel is typically about a foot to three feet in width. The lateral edges of the panels are bent in various configurations to form upwardly extending sides and a trough in the middle. The trough is where most of the water will be shed from the roof. Adjacent panels are joined along their upwardly extending sides to create relatively narrow seams which are elevated above the trough. The panels are laid out such that the seams run vertically, i.e., with the slope of the roof. The panels also may have one or more vertical ridges running through the trough, and it is those vertical seams and ridges that create the distinctive appearance that consumers associate with metal roofs. More importantly, however, since the seams between adjacent panels are formed a few inches above the troughs where most rain will be shed, metal panel roofs can be very resistant to leaking.

Skylights are widely installed to allow natural sunlight to enter a building through the roof. While problematic in roofs of all types, incorporating skylights in metal panel roofs present unique challenges. One approach has been to simply substitute a panel made from translucent fiberglass for a metal panel. That is, fiberglass panels are formed in more or less the same configuration, and installed vertically in more or less the same manner as the metal panels that are used in a roof. The fiberglass panel may occupy the entire run, or it may be truncated and extend through only a portion of the run. In the latter instance the truncated fiberglass panel is typically shingled into the run with truncated metal panels.

Such an approach has the advantage of simplicity, but fiberglass is more difficult to shape than metal panels with which it will be used. Substituting vertical fiberglass panels into an array of vertical metal panels, therefore, is practical only if the metal panels have a relatively simple shape. Corrugated panels may be used, as may be generally flat panels with simple raised geometry that allows the adjoining sides of the panels to overlap or nest. The sides of many metal panels, however, have relatively complex shapes and geometries which are intended to allow adjoining panels to be joined with a more leak resistant seam. It may be difficult or impossible to form fiberglass panels into a shape compatible with such panels.

Fiberglass panels also may not allow as much light to pass into a building as may be desired. Other materials, such as transparent or translucent plastics, allow more light to pass, but they have high coefficients of expansion. More significantly, their coefficient of expansion is much greater than metal panels with which they might be used. For example, an aluminum panel may expand and contract over a range of 2" per 100 linear feet. A steel panel may expand and contract even less, perhaps over a range of 1" per 100 linear feet. A similarly configured panel made from a plastic such as polycarbonate, however, may expand and contract over a range of 10" per 100 linear feet. Thus, plastic panels have not been substituted into an array of metal panels, if at all, to any significant degree, and certainly not plastic panels of any substantial length. There would be quite a bit of shift between a plastic panel and the rest of a metal roof, and creating a seal around a plastic panel that will withstand years of cyclic expansion and contraction would be difficult or impossible.

Domed skylights also may be installed in standing seam metal roofs. They typically incorporate a flanged dome formed from transparent or translucent plastic and are commonly installed in the trough between the seams. Examples of such skylights are disclosed in U.S. Pat. No. 4,860,511 to K. Weisner et al. Conceptually, however, that approach, other than the provision of a molded dome, is not different that incorporating truncated plastic panels as discussed above. Thus, they suffer from the same difficulty in establishing a seal around the skylight.

Domed skylights, however, also create a restricted flow path for water being shed from the roof. Water can easily back up and reach the seams around a domed skylight. That is a greater concern in colder climates where ice dams can form around the skylight. Expanding the width of panels or reducing the width of a skylight is not a practical option for avoiding such restrictions. The width of panels is constrained by many other considerations, and narrow skylights are not always desired.

A domed skylight also may be mounted on top of a box-like structure or curb. Curbed skylights effectively raise the seam around the skylight to a level well above the trough where most run-off occurs. The curb itself, however, remains as an obstruction to water flow. A curb also effectively doubles the seams associated with a skylight, there now being seams between the skylight and curb and seams between the curb and the roof. Moreover, curbed skylights add significantly to the cost of the skylight itself and its installation, and mounting a curbed skylight to accommodate thermal expansion of a metal roof may be problematic.

Skylights also may have to support substantial weight even when they are not designed per se for that purpose and persons on the roof are advised to avoid stepping on the skylight. Fiberglass panels have relatively higher load capacities. The plastics from which translucent portions of domed skylights most commonly are fabricated, however, all other factors being equal, do not have the load bearing capacity of metal or fiberglass panels. Such considerations create design constraints and may require the installation of additional support components that make installation of skylights more difficult and costly.

Accordingly, there remains a need for new and improved systems, apparatus and methods for providing skylights in roof covers, especially standing seam metal roof covers. Such disadvantages and others inherent in the prior art are addressed by various aspects and embodiments of the subject invention.

SUMMARY OF THE INVENTION

The subject invention, in its various aspects and embodiments, is directed generally to skylights and to roofs having skylights, and especially metal panel roof systems having skylights. One aspect of the invention provides for a skylight for installation in a roof comprising a cover. The skylight comprises a pair of elongated struts adapted for mounting vertically on opposing sides of an opening in the roof cover and a translucent panel mounted horizontally across the struts. The translucent panel has upwardly extending sides adapted to be joined to form horizontal seams, and the struts are adapted to support the translucent panel above the roof cover.

Other embodiments and aspects of the invention provide for skylights where the ends of translucent panels extend over a roof cover. Yet other embodiments provide for skylights where translucent panels are mounted on "Z" struts, and other embodiments where translucent panels are mounted on horizontally extending support flanges provided on struts. Still other embodiments provide skylights wherein struts have horizontally extending support flanges which, when the struts are installed in a roof, are adapted to extend horizontally beyond the opposing sides of an opening covered by the skylight and to terminate over a roof cover. Other embodiments provide skylights where a translucent panel is mounted at the ends thereof to strut support flanges by penetrating fasteners, the penetrating fasteners being installed through a portion of the flange extending over a roof cover.

Yet other embodiments provide skylights having translucent panels with symmetrical panel sides that are adapted to form a horizontal seam comprising a seam cover, skylights wherein the skylight comprises two translucent panels connected at their sides to form a horizontal seam, and skylights wherein two translucent panels have symmetrical sides which are connected by a horizontal seam comprising a seam cover.

The subject invention also provides for roofs having a skylight, the roof comprising a cover, a pair of elongated struts mounted vertically on opposing sides of an opening in the roof cover; and a translucent panel mounted horizontally across the struts. The translucent panel has upwardly extending sides adapted to be joined to form horizontal seams, and the struts are adapted to support the translucent panel above the roof cover.

Other embodiments and aspects of the subject invention provide for metal panel roof systems which comprise a support frame including an array of spaced purlins running horizontally through the support frame and a plurality of metal panels providing an outer cover for the roof system. The cover panels are mounted vertically across the array of purlins and have upwardly extending sides which are adapted to be joined to form vertical seams between the cover panels. There is an open space between a first one of the cover panels and a second one of the cover panels which is spaced horizontally from the first cover panel. A translucent panel is mounted horizontally over the open space. The translucent panel has upwardly extending sides adapted to be joined to form horizontal seams and is supported above the first and second cover panels.

Yet other embodiments and aspects provide roof systems where the ends of a translucent panel extend over a roof cover. Other embodiments provide a roof system which comprises a first elongated strut mounted across purlins proximate to a first cover panel, and a second elongated strut mounted across the purlins proximate to a second cover panel. The first and second struts each have a horizontally extending support flange that extends above the first and second panels, and a translucent panel is mounted on the support flanges.

Other embodiments provide a roof system which incorporates a "Z" strut, roof systems where first and second struts are attached to first and second elongated bearing plates, roof systems where support flanges on struts extend horizontally beyond cover panels sides and terminate over the cover panels, and roof systems where a translucent panel is mounted at the ends thereof to strut support flanges by penetrating fasteners, the penetrating fasteners being installed through a portion of the flange extending over the roof cover.

Still other embodiments and aspects of the subject invention provide roof systems which have skylights with translucent panel having symmetrical panel sides, and roof systems where the skylight has a second panel having upwardly extending sides adapted to be joined to form horizontal seams and the second horizontal panel is mounted adjacent to the horizontal translucent panel and is connected thereto by a horizontal seam. Other embodiments provide roof systems where the second panel in the skylight is a translucent panel or is a metal panel.

The invention also provides for methods of installing a skylight in a roof cover wherein any of the various embodiments of skylights are provided in a roof cover. Yet other embodiments provide methods for installing a skylight in a roof cover where an opening is provided in a roof cover, a translucent panel having upwardly extending sides adapted to be joined to form horizontal seams and defining a trough therebetween is provided, and the translucent panel is installed over the opening such that the translucent panel sheds water from the trough onto the roof cover.

Thus, the present invention in its various aspects and embodiments comprises a combination of features and characteristics that are directed to overcoming various shortcomings of the prior art. The various features and characteristics described above, as well as other features and characteristics, will be readily apparent to those skilled in the art upon reading the following detailed description of the preferred embodiments and by reference to the appended drawings.

Since the description and drawings that follow are directed to particular embodiments, however, they shall not be understood as limiting the scope of the invention. They are included to provide a better understanding of the invention and the manner in which it may be practiced. The subject invention encompasses other embodiments consistent with the claims set forth herein.

Figure 1:
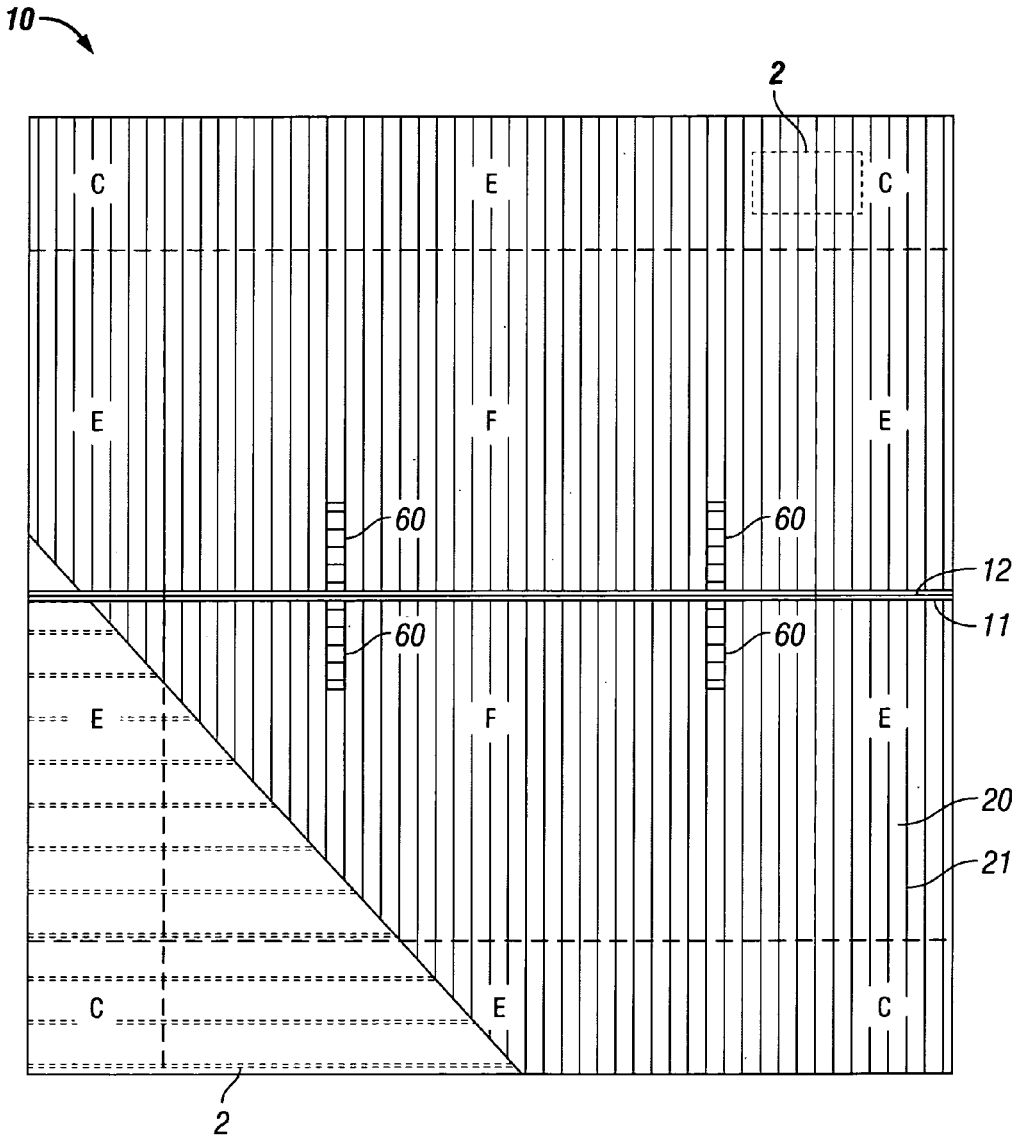
FIG. 1 is a plan view, including a partial tear-away view, of a first preferred embodiment 10 of the metal panel roofs of the subject invention, which novel roof 10 incorporates novel skylights 60.

In the drawings and in the description that follows, like parts are identified by the same reference numerals. The drawing figures are not necessarily to scale. Certain features of the invention may be shown exaggerated in scale or in somewhat schematic form and some details of conventional design and construction may not be shown in the interest of clarity and conciseness.

DESCRIPTION OF ILLUSTRATIVE EMBODIMENTS

The present invention generally relates to skylights for roof covers and roof covers having skylights. Broader embodiments comprise a roof with a skylight where the roof comprises a cover having an opening therein. A pair of elongated struts may be mounted vertically on opposing sides of the opening in the roof cover. Translucent panels may be mounted horizontally across the struts. The translucent panels have upwardly extending sides adapted to be joined to form horizontal seams. The struts are adapted to support the translucent panel above the roof cover.

Preferably, the roof covers are metal panels covers, especially standing seam metal panels. Standing seam metal panel covers generally comprise a support frame including an array of horizontally spaced purlins. A plurality of metal panels provide an outer cover for the roof cover. The panels are mounted vertically across the array of purlins and have upwardly extending sides which are adapted to be joined to form vertical standing seams between the panels.

Standing seam panels used in the novel metal roofs may be any of many types of standing seam panels as are conventionally used in metal panel roof covers. Thus, they may be fabricated from materials and by methods as are commonly employed in the art. Typically, such panels are fabricated from roll stock of painted or unpainted coated steel, such as Galvalume™ steel, zinc, copper, or aluminum. The roll stock is fed into a roll former which shapes the metal sheet into the desired configuration and cuts it to a desired length. Preferably, the former is mounted on a trailer or truck so that panels may be fabricated on a job site.

For example, the novel roof covers may incorporate "R" or "trapezoidal" standing seam panels, that have nesting longitudinal sides. The panels are laid over the roof so that their sides overlap and form a standing seam. The panels then are fastened to the purlins with screws that penetrate the top of the seams. Grounded and sealing washers also may be used to help establish and maintain a seal around fasteners. Such panels have been widely installed and are still being installed today, especially where cost is a primary concern.

The novel roof covers also may incorporate standing seam metal cover panels that are installed using non-penetrating fasteners, such as clips. Typically, individual clips are installed in vertical lines from one purlin to the next along what will become the seam line between panels. Panels are then installed between the vertical lines of clips, with the upturned seam edges of the panels abutting and mating with the clips and each other. There are no penetrations through the seam when clips are used, thus leak resistance through the seam is improved as compared to systems using screws or other "through panel" fasteners that penetrate the panels.

Clip systems may be used with both asymmetrical and symmetrical standing seam panels. Asymmetrical panels have mating male-female connections, each panel having a male connection formed in one side and a female connection formed in its other side. Thus, installation must proceed in a certain direction across the roof and removal for repair must proceed in the opposite direction. Symmetrical standing seam panels have sides which are identical and are joined with a separate seam cover. Symmetrical panels, therefore, may be installed in either direction. A damaged panel also may be removed for replacement without removing any adjacent panels.

For example, a novel metal panel roof 10 having a skylight is illustrated in FIGS. 1-14. As will be appreciated from FIGS. 1-4, novel roof 10 is a standing seam cover where cover panels 20 are mounted on an array of spaced, elongated bar joists or purlins 2 by a plurality of individual clips 30 and continuous clips 40. Purlins 2 provide a support structure on which are mounted the other components of novel metal panel 10 and its skylight. They are mounted on structural rafter beams (not shown) of a roof substructure and run "horizontally" through the roof. That is, purlins 2 are installed and run across the slope of a roof, as opposed to running "vertically" or with the slope.

Purlins 2 are "Z" purlins of the type widely used in metal roofs and building covers. As may be seen in FIG. 2, purlins 2 of novel roof cover 10 have a flange 3 extending generally horizontally in one direction from the lower end of a vertically oriented body 4. Another flange 5 extends generally horizontally in the other direction from the upper end of body 4. Lower flange 3 provides a base by which purlins 2 are attached to the rafter beams (not shown). Upper flange 5 provides a surface upon which cover panels may be mounted, either directly or indirectly, for example, by clips.

Figure 2:
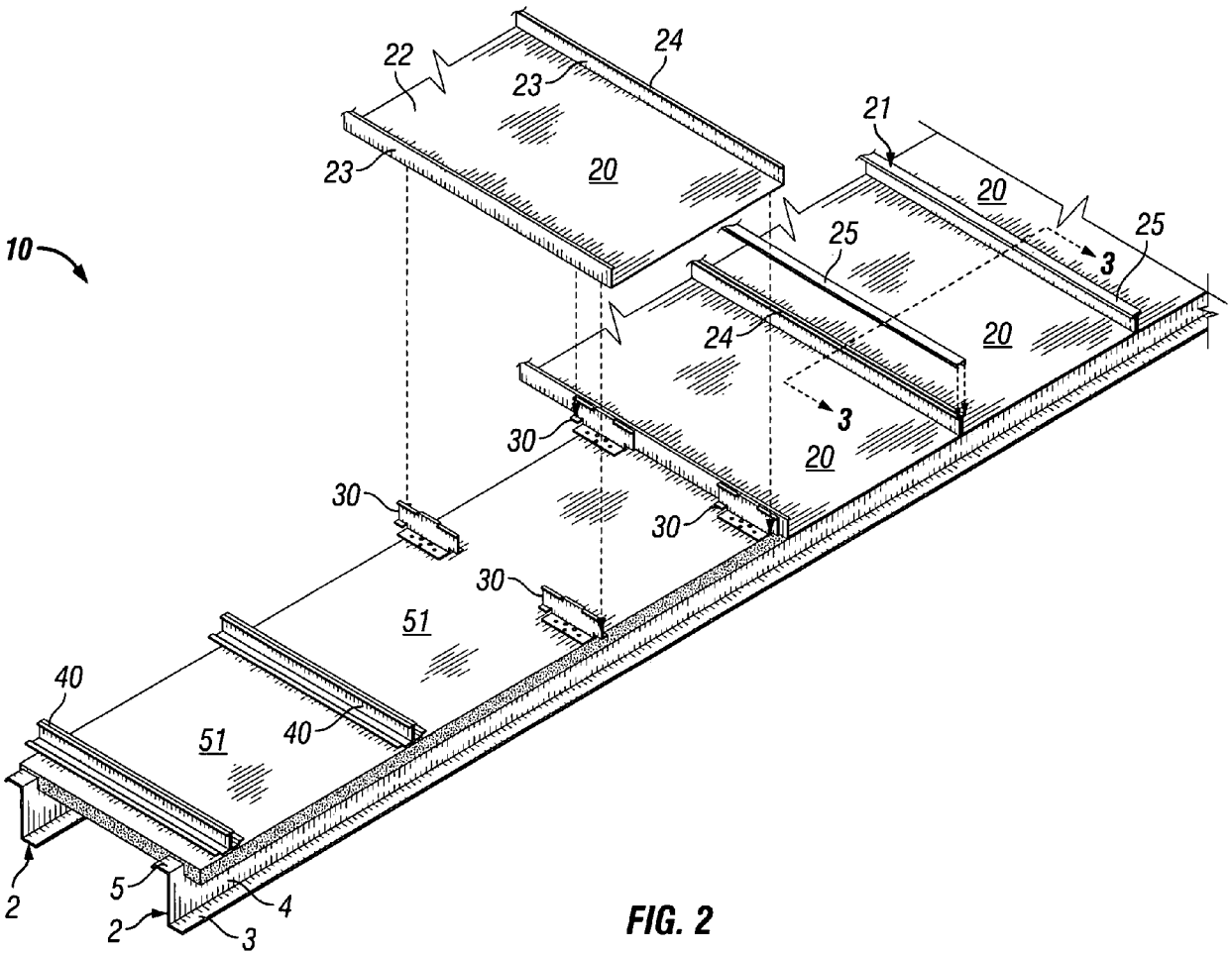
FIG. 2 is a perspective, partially exploded view of a portion of novel roof 10 taken generally from an area 2 of FIG. 1, which portion has been installed across a boundary between edge zone E and corner zone C of novel roof 10 (certain components of novel roof 10 having been omitted therefrom)
Figure 3:
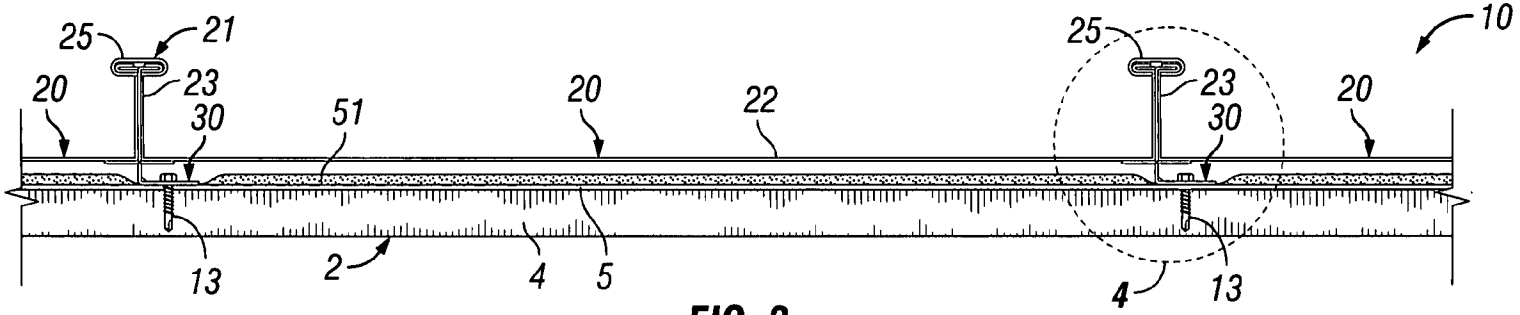
FIG. 3 is a cross-sectional view taken along line 3-3 of FIG. 2 of novel roof 10.
Figure 4:
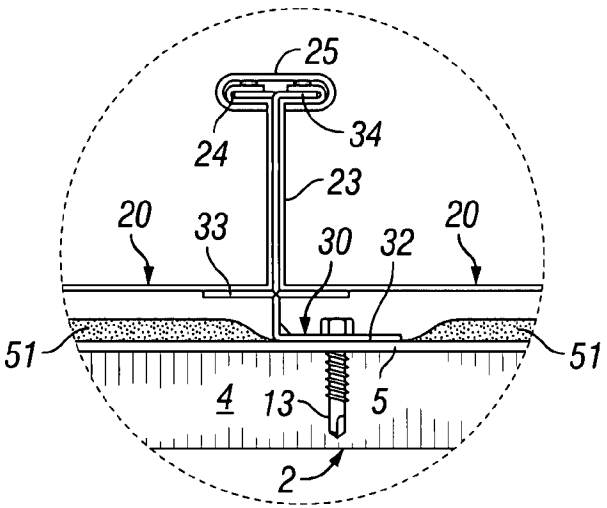
FIG. 4 is an enlarged, detailed view of portion 4 of the view shown in FIG. 3.

For example, as may be seen in FIG. 2, novel roof cover 10 has an array of individual clips 30 and continuous clips 40 which are mounted on upper flange 5 of purlins 2. Those clips 30 and 40 in turn support cover panels 20. Cover panels 20 run vertically and are interconnected along their lateral edges by standing seams 21. Standing seams 21 define troughs 22 through which water is shed from roof 10. The upper ends of cover panels 20, as may be seen in FIG. 1, extend under a ridge cap 11 provided along a peak line 12 of roof 10. Preferably, each cover panel 20 runs down the entire slope of roof 10 to an eave or valley. Alternately, the troughs may be provided by two or more panels overlapped at their ends.

Panel clips are used to secure cover panels to the purlins and to facilitate the formation of standing seams between cover panels. Individual clips 30 and continuous clips 40, for example, are used to secure cover panels 20 to purlins 2 and to facilitate the formation of seams 21 between adjacent panels 20 as shown in FIG. 2. They are mounted on upper flange 3 of purlins 2 by fasteners, such as screws 13, along the vertical seam lines between cover panels 20. Preferably, as shown in FIG. 2, insulation is provided, for example, by laying batts of fiberglass insulation 51 over purlins 2 prior to mounting clips 30 and 40. Other types of insulation, however, may be installed. Likewise, various barrier sheets, films, and decking also may be provided, if desired, to provide a vapor barrier, to reflect radiant heat, to provide fire resistance, or to provide additional support.

Resistance to uplift is an increasingly important consideration in roof design as property owners and insurers seek to minimize their potential losses from wind damage. Air flow forms low pressure areas over the roof and creates uplift forces that can peel metal panels or other roof coverings away from the roof. All parts of a roof, however, do not experience the same uplift forces in a given wind. The exposed edges of a roof experience greater uplift forces, and a given surface or field of a roof may be divided into three zones in recognition of such facts.

The "edge" zones include those areas within a certain distance, usually around 8 feet, of an eave or gable. If the pitch of a roof is greater than 2 inches per foot of slope, the areas adjacent the ridge and hip of the roof also are considered "edge" zones. The edge zones experience greater wind uplift pressures than most of the roof and typically constitute approximately 15% of a roof's surface. The greatest uplift pressures, however, are in the "corner" zones. Those are the areas where edge zones overlap, and they typically constitute approximately 5% of the surface of a roof. The "field" zone is the rest of the roof field and it constitutes approximately 80% of the roof surface. The field zone experiences the lowest wind uplift pressures.

Preferred embodiments of the subject invention, therefore, include metal panel roof covers in which individual panel clips are installed in the field of an existing roof and continuous clips are installed in corner zones, and where either individual or continuous clips are installed in edge zones of the existing roof. For example, novel roof cover 10 includes large field zones F, edge zones E, and corner zones C as shown in FIG. 1. Individual panel clips 30 are installed in field zones F and edge zones E and continuous clips 40 are installed in corner zones C. That may be best appreciated by reference to FIG. 2, which is a section of novel roof 10 installed across a boundary between an edge zone E and a corner zone C.

As exemplified therein, individual clips 30 are mounted on purlins 2 in linear arrays. The arrays of individual clips 30 run vertically through field zones F and edge zones E of novel roof 10 along what will become seam lines for cover panels 20. Thus, the linear arrays of clips 30 are separated horizontally by a distance substantially equal to the width of cover panels 20.

Continuous clips 40 are installed in corner zones C of roof 10. Like individual clips 30, continuous clips 40 are mounted along seam lines for cover panels 20 and thus are offset from each other by a distance approximately equal to the width of panels 20. In contrast to individual clips 30, however, continuous clips 40 are elongated and extend across adjacent purlins 2. Continuous clips 40, therefore, provide continuous support for panels 20 through corner zones C, thus providing greater resistance to wind uplift in those areas experiencing the greatest uplift forces.

If desired or necessary, increased resistance to wind uplift may be provided in roof edge zones by providing continuous clips in those zones instead of individual clips as in roof 10. Similarly, in those zones where they are employed, individual clips typically will be installed on every purlin along the seam line as are clips 30 in roof 10. If resistance to wind uplift is not a great concern, however, it may not be necessary to install an individual clip on every purlin. It also will be appreciated that continuous clips preferably extend across the entire corner zones or, if employed therein, the edge zones of a roof. Shorter continuous clips may, be employed, however, and arranged in a line across the zone such that their ends overlap, abut, or are spaced somewhat apart with the result that support for cover panels is provided across substantially the entire run through the zone. In any event, by selectively installing either individual or continuous clips across the roof, it is possible to provide a standing seam roof cover with increased resistance to wind uplift in those areas requiring greater resistance, yet which requires fewer parts, may be installed more easily, and has lower material costs.

Figure 5:
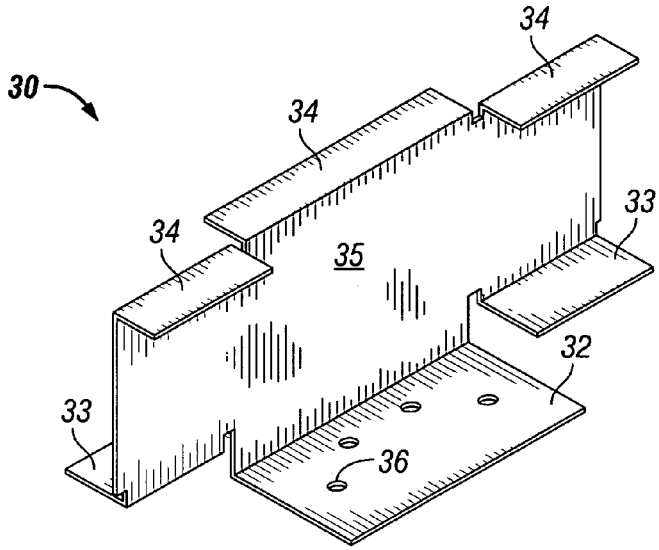
FIG. 5 is a perspective view of a preferred embodiment 30 of individual panel clips 30 used in novel roof 10 shown in FIGS. 1-4.

More particularly, as shown more specifically in FIG. 5, individual clips 30 which are installed in field zones F and edge zones E include a bottom flange 32, shelf flanges 33, and top flanges 34 that extend generally horizontally from a vertically oriented web or body 35. Bottom flange 32 provides a base by which clips 30 are attached to purlins 2 by, for example, driving screws 13 into purlins 2. Round apertures 36 preferably are provided in base 32 to accommodate screws or other fasteners, but if desired, slots may be provided, or screws may be driven through base 32.

The length of clips 30 and base 32 thereof, as well as the placement, configuration, and number of apertures 35, preferably are coordinated to allow for some imprecision in placement of clips 30 during installation while ensuring that a sufficient number of fasteners may be driven into existing purlins. It also is preferable that base 32 be sufficiently long so as to extend across the entire width of purlins so as to allow for a more stable and secure connection thereto. Also, while base 32 of clips 30 is formed from a continuous flange extending from body 35, other configurations are within the scope of the invention. For example, the base of an individual clip may be formed from two or more flanges extending alternately in opposite directions from the clip body.

Shelf flanges 33 have a first more or less horizontal portion which, along with top flanges 33, provides support for cover panels 20. Top flanges 34 also facilitate the formation of standing seams 21 between cover panels 20. That is, as best appreciated from the cross-sectional views of FIGS. 3-4, the lateral edges of panels 20 are bent upwards to provide upwardly extending sides 23 on both sides of trough 22. The upper portion of panel sides 23 is doubled over inwardly and horizontally to form a narrow U-shaped channel 24 running vertically on top of each side 23 of panels 20. It will be noted that cover panels 20 are symmetrical, that is, their sides 23 are mirror images.

As cover panels 20 are installed, therefore, sides 23 of panels 20 will be supported on the top surfaces of shelf flanges 33 in adjacent lines of clips 30. At the same time, U-shaped channels 24 in the upper portion of sides 23 of panels 20 are slipped over top flanges 34. A seam cover 25 then is provided over and around the exterior of channels 24 to secure panels 20 to each other and to clips 30. Preferably, a sealant, such as a bead of silicone caulk or elastomeric tape, is provided between seam cover 25 and the exterior of channels 24 to enhance the weather tightness of seams 21. A reamer also may, and preferably is used to securely connect and seal seam cover 25 to panel sides 23.

The exact dimensions of shelf flanges and top flanges in the novel individual clips are not especially critical and may be varied somewhat to provide as much or as little support surface as may be desired or necessary for a particular installation. Likewise, clips 30 have three top flanges 34, two flanges 34 extending in one direction and one flange 34 extending in an opposite direction. Other clips, however, may be provided with any number of top flanges extending in alternating directions.

Figure 6:
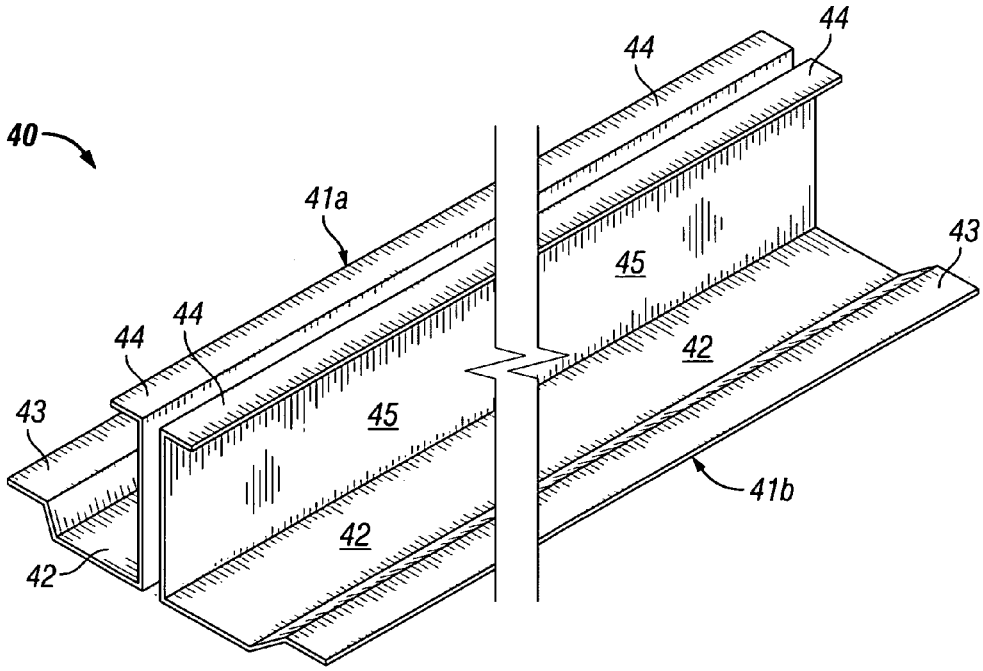
FIG. 6 is an exploded perspective view of a preferred embodiment 40 of continuous panel clips used in novel roof 10 shown in FIGS. 1-4.
Figure 7:
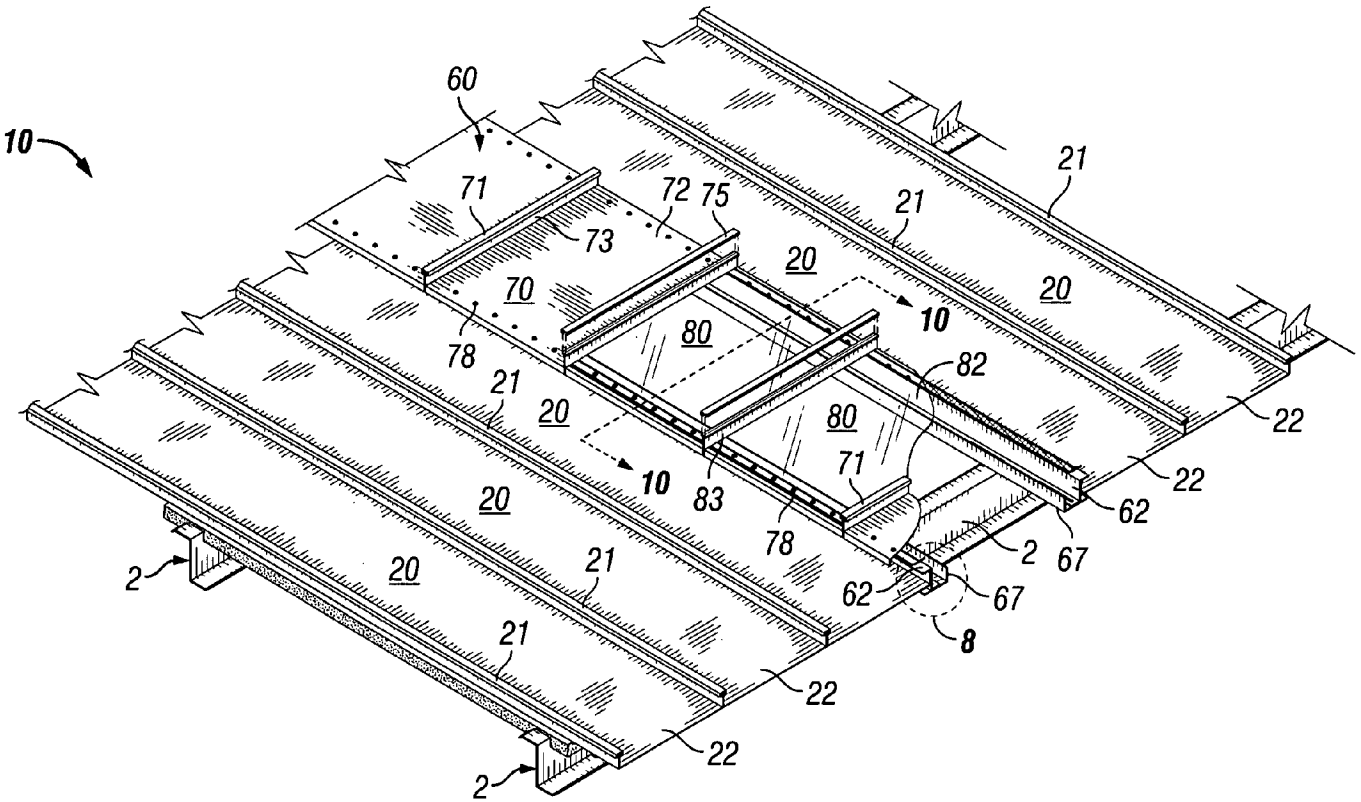
FIG. 7 is a perspective view, including a partial tear-away view, of a mid-portion of novel roof 10 shown in FIG. 1 that includes a novel skylight 60 and shows novel skylight 60 in greater detail.
Figure 8:
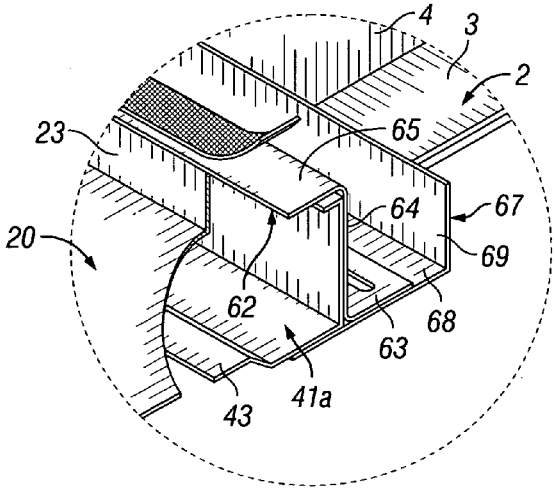
FIG. 8 is an enlarged, detailed view, with a partial tear-away, of portion 8 of the view shown in FIG. 7.
Figure 9:
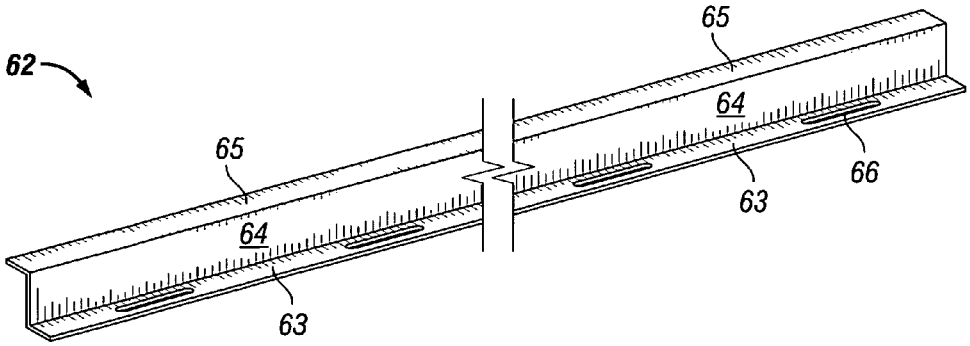
FIG. 9 is a perspective view of a preferred embodiment 62 of struts incorporated into novel skylight 60.

Continuous clips 40, as seen best in FIG. 6, are formed from two identical components 41*a* and 41*b*. Clip components 41 have a generally c-shaped cross-section and are installed in back-to-back fashion such that the overall cross-section of continuous clips 40 is generally I-shaped. More particularly, clip components 41 have a bottom flange 42 and a top flange 44 extending generally horizontally from a vertically oriented web or body 45. Bottom flange 42 provides a base by which clips 30 are attached to purlins 2 by, for example, driving screws 13 into purlins 2. The screws typically are driven through base 42 to simplify installation of continuous clips 40. If desired, however, holes, slots or other apertures may be provided in base 42 to accommodate the passage of fasteners.

The length of clip components 41 is coordinated such that clips 40 span at least the distance between adjacent purlins 2 in roof 10, but preferably such that clips 40 extend across all purlins 2 in the corner zone of roof 10. The width of base 42, as well as the placement, configuration, and number of any apertures present, preferably are coordinated to allow for some imprecision in placement of clip components 41 during installation while ensuring that a sufficient number of fasteners may be driven into existing purlins.

Base 42 has an upwardly angled extending portion from which extends a horizontal shelf flange 43. Shelf flange 43, along with horizontally extending top flange 44, provides support for cover panels 20. Top flanges 44 also facilitate the formation of standing seams 21 between cover panels 20. As panels 20 are installed, sides 23 of panels 20 will be supported on shelf flanges 43 in adjacent lines of clips 40. At the same time, U-shaped channels 24 in the upper portion of sides 23 of panels 20 are slipped over top flanges 44. A seam cover 25 then is provided over and around the exterior of channels 24 to secure panels 20 to each other and to clips 40. Sealants and seamers also are preferably used to form a secure, weather tight seam along continuous clips 40.

The clips used in the novel metal panel roof covers preferably are made from steel, such as 16 to 22 gauge galvanized steel sheets that may be easily formed and bent and cut into a desired configuration by conventional metal forming equipment. Such materials provide a rugged, weather resistant clip that may be manufactured easily and economically. Continuous clips, given their length, may be made from somewhat lighter gage metal if desired to reduce costs and to more easily allow screws to be driven through the clip instead of providing apertures to accommodate fasteners. Other metals, such as extruded aluminum, may be used to fabricate the panel clips, however, as well as rigid, moldable or extrudable plastics.

Likewise, while individual clips 30 and continuous clips 40 are used in preferred embodiments of the novel roof covers, the invention is not limited thereto. Other clip configurations may be used if desired. For example, while individual clips 30 in novel roof cover 10 are a unitary component, other individual clips suitable for use in other embodiments of the subject invention may have a two-piece design, similar to continuous clips 40. Likewise, continuous clip 40 may be fabricated as a unitary component, analogous to individual clips 30. The various flanges in the exemplified clips are integral with their associated clip body. If desired, however, the various flanges may be provided as separate components affixed to a clip body, e.g., by welding.

Alternately, continuous support for panel seams across adjacent purlins may be provided by providing a panel support member which straddles two individual clips across their shelf flanges. The panel support member may be attached and secured to individual clips by any means known in the art, such as glue, welding, or fasteners. The panel support member includes a substantially flat upper surface and a bent flange on each edge of the substantially flat upper surface. The substantially flat upper surface of the panel support member is configured to contact and support the cover panel, for example, by engaging U-shaped channels in a manner analogous to that described above. The panel support member essentially connects the individual clips and creates a support structure for the cover panels.

Novel roof cover 10 is installed over a relatively flat roof support frame (not shown), that it, it is a "structural" roof cover. Structural metal panels are most commonly used over relatively low slope roofs, although even "flat" roofs preferably have a minimum of 0.25 inch per foot of slope to provide runoff. A structural panel roof cover can support its own weight without a deck since the metal panels have higher seams, usually from 2 to 3 inches. The seams of a structural cover are hydrostatic. That is, they are designed to be water tight since the seams may have to withstand pressure from ponding water.

The roof cover, however, may be an "architectural" roof cover. Architectural metal panels are generally installed over relatively steep roofs, those having a minimum slope of about 3 inches per foot of slope, where visual impact or aesthetics may be more valued. Panel seams in architectural metal panel roofs are hydrokinetic, i.e., water shedding. Since the seams are relatively short, usually 0.5 to 1.5 inches high—a supporting deck usually is installed over the roof rafters to provide support for the panels.

When a metal panel roof is being installed, one or more runs of cover panels may be omitted, either completely or partially, to create an opening in the roof. For example, as will be appreciated from FIG. 1, a run of panels 20 has been partially omitted in four areas of roof 10 to provide openings over which are mounted four novel skylight assemblies 60. Skylights 60 run generally vertically across novel roof 10 from under ridge cap 11. They may run down the entire slope of roof 10 to an eave or valley or, as shown in FIG. 1, terminate short thereof. Similarly, they may be installed across an opening created by omitting a single run, as shown in FIG. 1, or across wider openings created, for example, by completely or partially omitting adjacent runs of panels.

The novel skylights, in their broader embodiments, comprise a pair of elongated struts which are adapted to be mounted vertically on opposing sides of an opening in a roof cover. A translucent panel is mounted horizontally across the struts. The translucent panel has upwardly extending sides adapted to be joined to form horizontal seams. The struts are adapted to support the translucent panel above the roof cover.

For example, as illustrated by FIGS. 1 and 7-14, novel skylights 60 in novel roof 10 generally comprises an array of opaque panels 70 and translucent panels 80 mounted horizontally across vertically mounted struts 62. As may be seen best in FIGS. 7-11, struts 62 provide a support structure on which are mounted the other components of novel skylight 60. They run vertically through the roof on each side of an opening in roof 10 and are mounted on angle supports 67. Angle supports 67 in turn are mounted to purlins 2. As will be appreciated from the description that follows, struts 62 support the horizontal panels 70 and 80 above the roof cover panels 20 so that, as is preferred, horizontal panels 70 and 80 may be configured to shed water, if not off an eave or into a valley, onto adjoining cover panels 20.

Struts 62 are "Z" struts of the type widely used in metal roofs and building covers. As may be seen best in FIG. 9, struts 62 of novel skylights 60 have a flange 63 extending generally horizontally in one direction from the lower end of a vertically oriented body 64. Another flange 65 extends generally horizontally in the other direction from the upper end of body 64. Lower flange 63 provides a base by which struts 62 are attached to their respective angle support 67 by, for example, driving fasteners, such as screws 76 into angle supports 67. Apertures may be provided in base 63 to accommodate screws or other fasteners, or screws may be driven through base 63. Preferably, however, slots, such as slots 66, are provided in base 63 to allow skylight 60 to shift to accommodate thermal expansion and contraction of roof 10. Upper flange 65 provides a surface upon which horizontal panels 70 and 80 may be mounted.

As seen best in FIGS. 7-8 and 10-11, skylights 60 incorporate a pair of struts 62, one each on each side of the opening in roof 10. Additional struts may be installed between struts 62, if desired, to provide additional support, especially for longer horizontal panels. Additional support may be provided by installing braces between struts 62, for example, braces tied into lower flanges 63 of struts 62. Moreover, while "Z" struts may be easily fabricated, may be easily installed, and provide support for the skylight assembly and its various components with an economy of features, other types of struts may be used. Struts having a C-shaped or I-shaped cross section, for example, may be adapted for use in the novel skylights. Suitable struts also may be provided by the assembly of multiple components.

Additional support members also may be provided if desired. For example, as may be seen best in FIGS. 7-8 and 10-11, novel skylights 60 further comprise angle supports 67 which are mounted on purlins 2 under struts 62. Angle supports 67 have a flange 68 extending generally horizontally in one direction from the lower end of a vertically oriented body 69. Lower flange 68 provides a base by which angle supports 67 are attached to purlins 2 by, for example, driving fasteners such as screws 76 into purlins 2. Apertures may be provided in base 68 to accommodate screws or other fasteners, or screws may be driven through base 68. Lower flange 68 also provides a base to which struts 62 may be connected.

In any event, an array of opaque panels 70 and translucent panels 80 is mounted horizontally across struts 62. Opaque panels 70 are identical to panels 20 in novel roof, except that they are mounted horizontally across roof 10 instead of vertically, but will be referred to as "opaque" panels in the context of describing skylights 60. Thus, the lateral edges of opaque panels 70 are bent upwards to provide upwardly extending sides 73 on both sides of trough 72. Though not necessary, as will be appreciated from the description that follows, the upper portion of panel sides 73 is doubled over inwardly and horizontally to form a narrow U-shaped channel running vertically on top of each side 73 of panels 70. It will be noted that cover panels 70 are symmetrical, that is, their sides 73 are mirror images.

Translucent panels 80 are similar in their design to opaque panels 70. The lateral edges of translucent panels 80 are bent upwards to provide upwardly extending sides 83 on both sides of a trough 82. The upper portion of panel sides 83 extends inwardly and horizontally to form a horizontal flange similar to the U-shaped channels at the top of sides 73 of opaque panels 70. Thus, translucent panels 80 also are symmetrical.

The translucent panels in the novel skylights may be made from any material which allows a desired degree of light transmission and which may be formed as described herein. Theoretically, glass panels may be used, for example. More typically, however, the translucent panels will be made from plastic materials commonly used in fabricating skylights of other designs. Such materials include acrylic, cellulose acetate butyrate (CAB), polycarbonate, and other plastics, most commonly in sheet form. Such materials are readily available and have sufficient workability so that they may be bent and otherwise formed into the desired configurations.

As best appreciated from FIGS. 7-8 and 10-11, opaque panels 70 and translucent panels 80 are disposed horizontally across upper flange 65 of struts 62 preferably with a sealant, such as tape sealant provided therebetween. Struts 62 support horizontal panels 70 and 80 at a level above the side walls 23 of the cover panels 20 running vertically adjacent to skylight 60. Panels 70 and 80 preferably are of sufficient length that the ends thereof terminate beyond the proximate side walls 23 and U-shaped channels 24 of adjacent cover panels 20. Thus, water being shed from troughs 72 and 82 of, respectively, panels 70 and 80, will flow into troughs 22 of adjacent cover panels 20.

Figure 10:
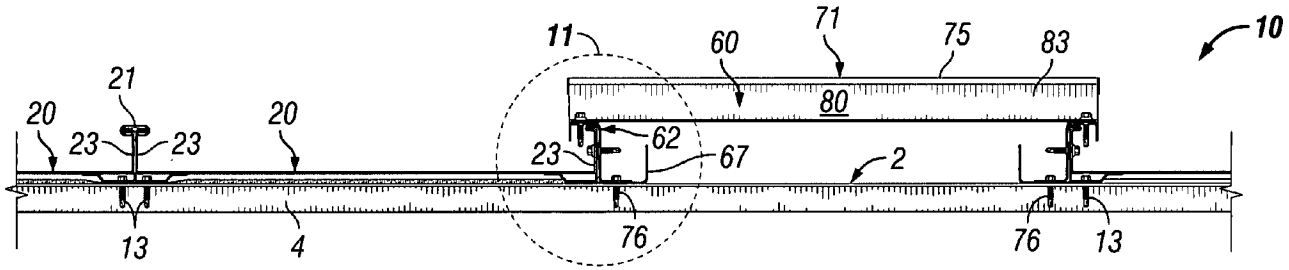
FIG. 10 is a cross-sectional view taken along line 9-9 of FIG. 7 of a portion of novel roof 10 including skylight 60.
Figure 11:
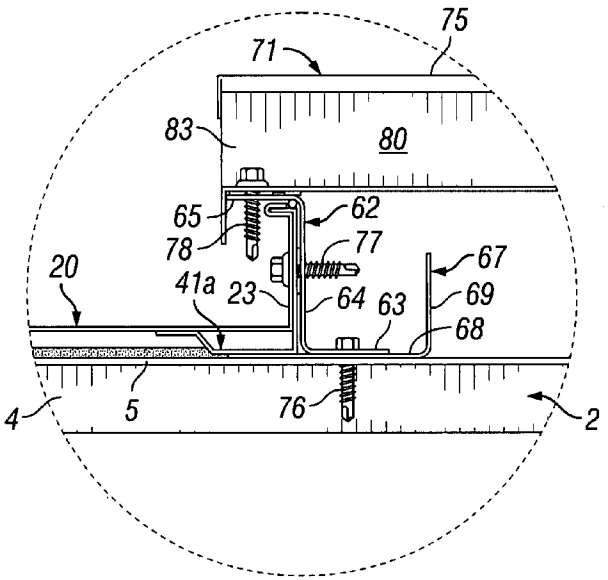
FIG. 11 is an enlarged, detailed view of portion 11 of the view shown in FIG. 10.
Figure 12:
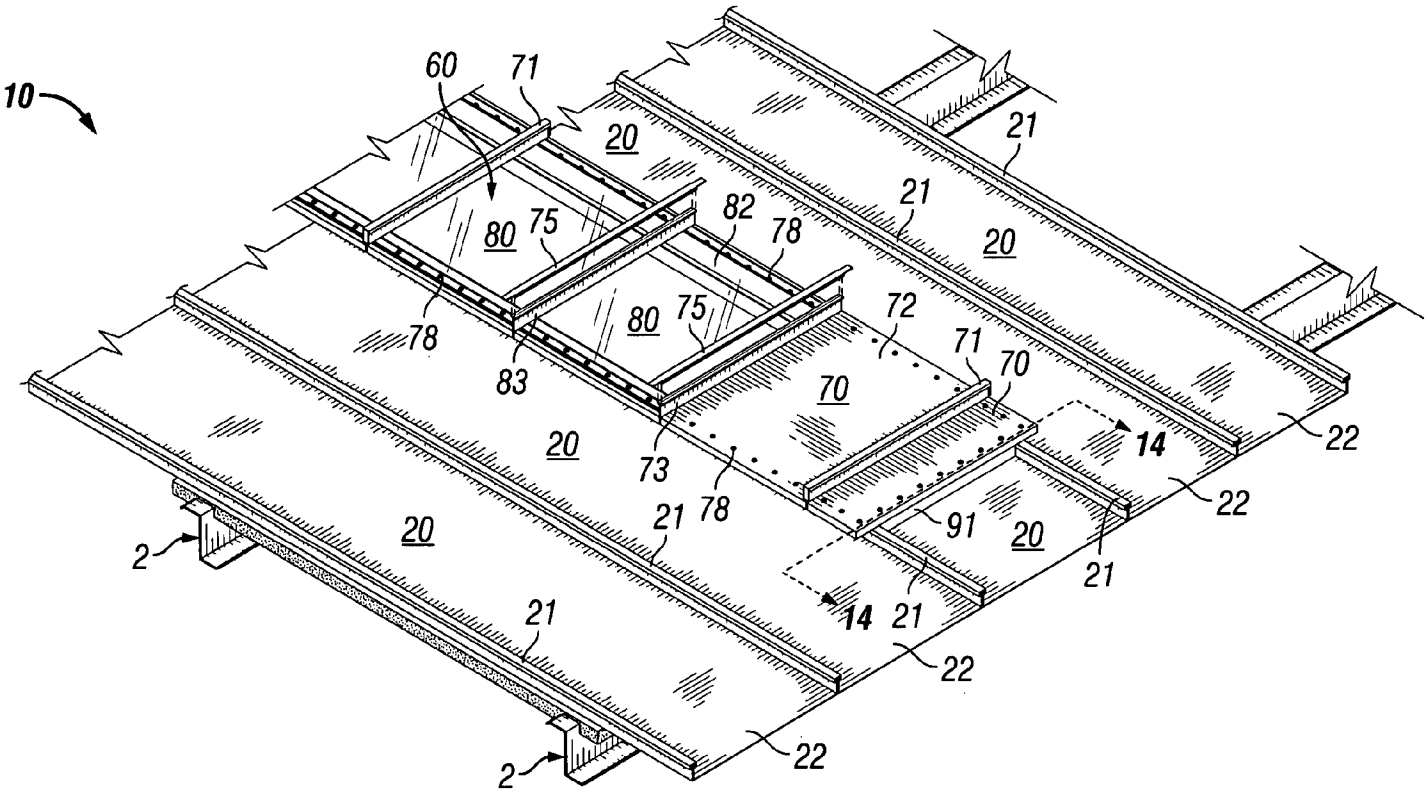
FIG. 12 is a perspective view of a portion of novel roof 10 shown in FIG. 1 that includes the downslope end of novel skylight 60.

It also will be appreciated that adjacent panels 20 may be secured to skylight 60, for example, by driving fasteners such as screws 77 through their sides 23 into body portion 64 of struts 62 as shown in FIGS. 10-11. Grounded and sealing washers may be provided, if desired. In any event, because the ends of panels 70 and 80 extend well into troughs 22 of adjacent panels 20, the fasteners connecting adjacent panels 20 to skylight 60 will be covered and less susceptible to developing leaks. Such cover may be enhanced by bending the ends of horizontal panels 70 and 80 downward.

Panels 70 and 80 may be mounted on struts 62 by any suitable means. Adhesives may be used, as may be a variety of fasteners. For example, as may be seen in FIG. 7, fasteners such as screws 78 may be driven through panels 70 and 80 at each ends thereof into upper flange 65 of struts 62. As best seen in the cross-sectional views of FIGS. 10-11, upper flange 65 of struts 62 extends horizontally over and beyond U-shaped channels 24 in proximate sides 23 of adjacent cover panels 20. Preferably, as shown, it extends sufficiently beyond channels 24 so that fasteners 78 may be installed beyond the horizontal extent of channels 24 as well. Thus, if any leaks develop around fasteners 78, water will be shed into troughs 22 of adjacent cover panels 20.

Adjacent horizontal panels 70 and 80 may be joined together along their lateral edges by standing seams 71 in a manner similar to the manner in which standing seams 21 are formed between cover panels 20 in roof 10. That is, opaque panels 70 and translucent panels 80 are disposed horizontally across struts 62 such that their adjacent sides 73 and 83 abut each other. The U-shaped channels of sides 73 of opaque panels 70 and the upper horizontal flange extending from sides 83 of translucent panels 80, as the case may be, provide an abutment between adjacent horizontal panels 70 and 80 which has a T-shaped cross-section. A seam cover 75 then is provided over and around the top of the T-shaped abutment to secure horizontal panels 70 and 80 to each other. Preferably, a sealant, such as a bead of silicone caulk or elastomeric tape, is provided between seam cover 25 and the top of the abutment to enhance the weather tightness of seams 75. A seamer also may, and preferably is used to securely connect and seal seam cover 25 to panel sides 73 and 83. Likewise, a sealant preferably is provided between sides 73 and 83 of horizontal panels 70 and 80, as the case may be, at the ends thereof to further minimize ingress of moisture between adjacent horizontal panels 70 and 80.

It will be appreciated that the novel skylights may incorporate plastic horizontal panels, yet still have relatively high load capacities. The translucent horizontal panels, which most commonly will be fabricated from translucent plastics, are provided with standing seams, thus increasing their load capacity. Because the support struts run vertically and preferably are mounted on the roof cover purlins, they may be provided not just on the sides of a skylight opening, but in whatever number at whatever spacing across the opening as may be desired to support the horizontal panels. Braces also may be installed under horizontal panels between the supporting struts to provide higher load capacities.

It also will be appreciated that novel skylights 60 are able to utilize opaque panels 70 having the same construction as cover panels 20 provided elsewhere in roof 10. The U-shaped channels in opaque panels 70, which otherwise are designed to receive flanges of a clip, may be engaged with a seam cover to provide a standing seam between horizontal panels. There is no need to fabricate special opaque panels. If desired, however, opaque horizontal panels may be provided with a simple horizontal flange, similar to the flanges extending from sides 83 of translucent panels 80, that may be engaged by a seam cover.

Likewise, horizontal panels 70 and 80 may be joined easily and economically with leak resistant standing seams 71. Translucent panels 80 also may be easily formed into the desired configuration. Other types of standing seam panels, however, both opaque and translucent, may be used in the novel skylights. There are any number of standing seam panels designed to be installed with clips that may be incorporated into the novel skylights, with or without clips, as either opaque or translucent panels. They may be asymmetrical, but preferably are symmetrical. Although generally more susceptible to developing leaks, trapezoidal standing seam panels also may be used.

It will be appreciated that the width and length of horizontal panels may be varied to provide whatever coverage is need for a particular skylight. More importantly, however, the novel skylights are able to provide great flexibility in sizing a skylight with essentially the same components. That is, the novel skylights may be made to fit a wider opening simply by lengthening the horizontal panels. They may be made to fit a longer by incorporating a greater number of horizontal panels. The invention, therefore, is not limited to any particular array of horizontal panels. Greater or fewer may be used. They also may all be translucent panels, or opaque panels may be interspersed, in regular patterns or otherwise, for aesthetic reasons.

Importantly, the novel skylights, even when composed of materials such a plastic which have a relatively high coefficient of expansion as compared to the metal panels with which they will be used, also may be better capable of accommodating the thermal expansion that occurs in many metal panel roofs. For example, even an extremely long skylight need not be fabricated from long plastic components. A relatively long skylight may be provided simply by including a relatively large number of translucent horizontal panels, each of which has a relatively short vertical expanse. Thus, the novel skylights may be better able to accommodate differing coefficients of thermal expansion that necessarily exist, especially when a relatively long skylight is desired.

The novel skylight assemblies are provided with various assemblies to secure and weatherproof the lower ends thereof and to shed water across an eave, into a valley, or a trough of a cover panel in the roof. For example, as may be seen in FIG. 12, skylight assembly 60 is designed to shed water at its lower end primarily into trough 22 of a downslope cover panel 20. As shown in greater detail in FIGS. 14-15, lower end of skylight 60 has an end assembly 90 that generally includes a closure 91, a Z-brace 92, and a support plate 93.

Figure 13:
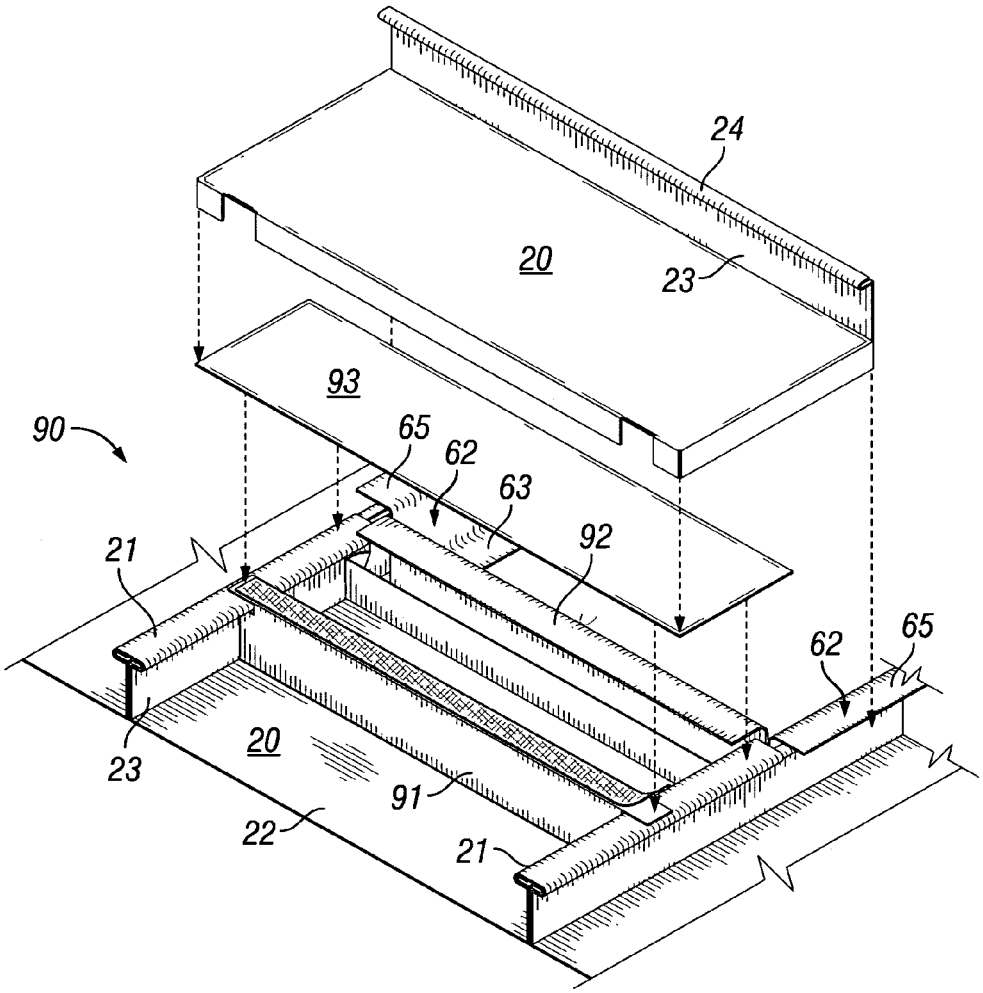
FIG. 13 is an exploded perspective view of the downslope end of novel skylight 60 shown in FIG. 12.
Figure 14:
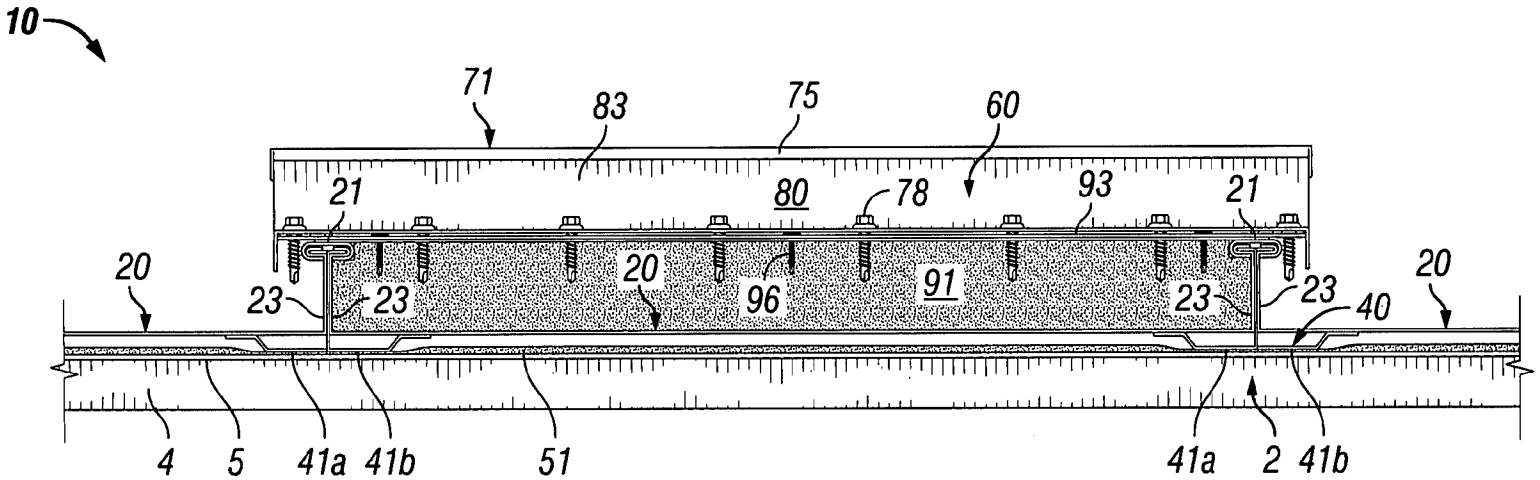
FIG. 14 is a cross-sectional view taken along line 14-14 of FIG. 12 of the downslope end of novel skylight 60 shown in FIGS. 12-13.

Closure 91, as seen best in FIG. 13, extends horizontally across trough 22 and between sides 23 of downslope cover panel 20. It serves to block ingress of ponding or wind driven moisture into the area covered by skylight 60. It may be of any general configuration and composition consistent with such purposes. Preferably, however, closure 91 comprises a generally U-shaped metal sheath that fits over a core of pliable foam insulation such as neoprene. Such pliable foams may be somewhat oversized and pressed into place to provide a better seal with downslope panels 20. The metal sheath of closure 91 may be secured in place by any suitable means, for example, by providing it with ears or tabs (not shown) that extend along sides 23 of downslope cover panel 20 and driving screws through the ears into clips (not shown) to which downslope panel 20 is mounted.

Horizontal Z-brace 92 extends between struts 62 just above the upper terminus of downslope panel 20. It will be noted that the upper end of downslope panel 20 preferably, as shown in FIG. 13, is folded upward to provide further protection against ingress of wind driven moisture. In any event, Z-brace 92 is mounted to a purlin 2 or to lower flanges 63 of struts 62 by, for example, driving fasteners through the lower flange of Z-brace 92.

Support plate 93 is disposed on the upper surfaces of closure 91, the top flange of Z-brace 92, and standing seams 21 formed in downslope cover panel 20. Preferably, a sealant, such as a bead of silicone caulk or elastomeric tape, is provided therebetween to enhance the weather tightness of assembly 90. Support plate 93 may be secured in place, for example, by driving suitable fasteners through support plate 93 into the top of closure 91 and the top flange of Z-brace 92. A ripped horizontal panel, such as opaque panel 70, then is disposed over plate 93 and secured by, for example, driving fasteners such as screws along its edges into plate 93. Support plate preferably extends beyond standing seams 21 in downslope cover panel 20 a sufficient distance such that fasteners 78 may be installed beyond the horizontal extent of standing seams 21 as well. Thus, if any leaks develop around fasteners 78, water will be shed into troughs 22 of adjacent or downslope cover panels 20.

End assembly 90 provides good support for ripped horizontal panel 70, as well as an effective and economical closure for the lower end of skylight 60. Other components and assemblies, however, may be employed for such purposes. The novel skylights are not limited to particular end assemblies.

As noted above, the upper ends of skylights 60 extend from under ridge cap 11 of novel roof 10. That may be provided most easily by ripping a horizontal panel, such as an opaque panel 70, and disposing the ripped side under ridge cap 11 with, preferably, a sealant. Ridge cap 11, therefore, will shed water into trough 72 of ripped horizontal panel 70, which will in turn shed water into troughs 22 of adjacent cover panels 20. Thus, ponding of water above skylights 60 will be minimized, if not avoided altogether. If desired, however, the novel skylights may be installed below the ridge cap by providing a suitable end assembly, such as end assembly 90 or another end assembly providing a hydrostatic closure of the upper end of the skylight.

It will be appreciated that the novel skylights have been illustrated in the context of metal panel covers. In such installations the novel skylights may be provided using many of the same or similar components as are used in installing the cover. Thus, material and installation costs may be reduced as compared to skylights requiring many unique components and installation methods. At the same time, however, the novel skylights may be used with other types of roof covers, such as rubber or shingled roofs.

Figure 15:
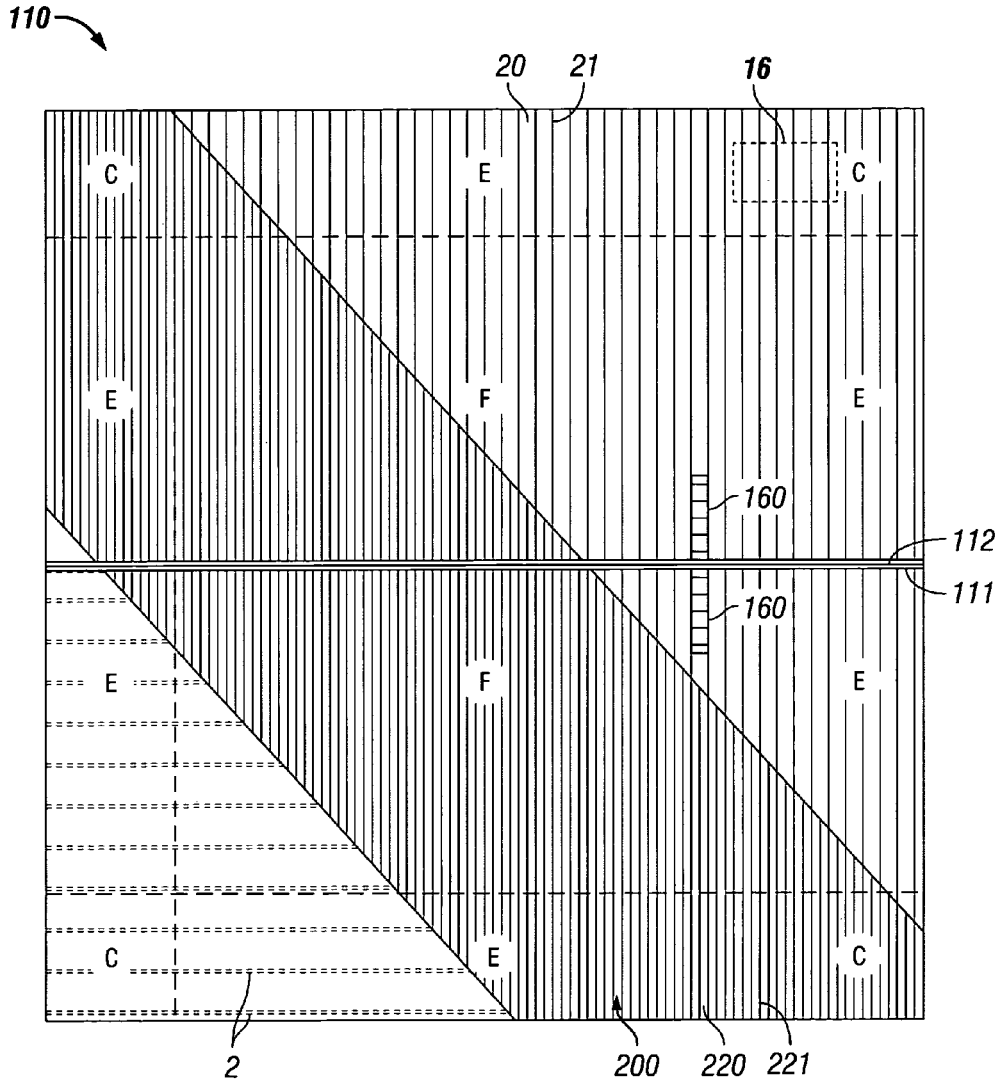
FIG. 15 is a plan view, including partial tear-away views, of a conventional metal panel roof 200 which has been recovered with a second preferred embodiment 110 of the subject invention.

It also will be appreciated that the subject invention also encompasses skylights for roof covers and roof covers having skylights where the roof cover is installed over an existing roof, what may be called a "recover." For example, as shown generally in FIG. 15, novel roof recover 110 may be installed over an existing roof, such as existing roof 200.

Existing roof 200 is typical of exposed fastener metal roofs that have been installed in great numbers over the past few decades. As best appreciated from FIG. 16, it includes an array of purlins 202 mounted on structural rafter beams (not shown) of a roof substructure and that run horizontally through the roof. Purlins 202, like purlins 2, are "Z" purlins of the type widely used in metal roofs and building covers. As seen best in FIG. 16, purlins 202 of existing roof 200 have a flange 203 extending generally horizontally in one direction from the lower end of a vertically oriented body 204. Another flange 205 extends generally horizontally in the other direction from the upper end of body 204. Lower flange 203 provides a base by which purlins 202 are attached to the rafter beams (not shown). Upper flange 205 provides a surface upon which is mounted a series of overlapping elongated panels 220.

Panels 220 in existing roof 200 run vertically across purlins 202 and have upturned longitudinal sides that overlap to form raised lap ridges 221. Existing panels 220 also have, as is typical of panels of this type, a number of vertical ridges 226 formed in trough 222 extending between lap ridges 221. Panels 220 are supported by and attached to upper flange 204 of purlins 202 by penetrating fasteners, such as screws (not shown), which are installed in the troughs 222 of panels 220. Panels 220 also are interconnected by screws or other penetrating fasteners (not shown) installed along overlapping lap ridges 221.

Figure 16:
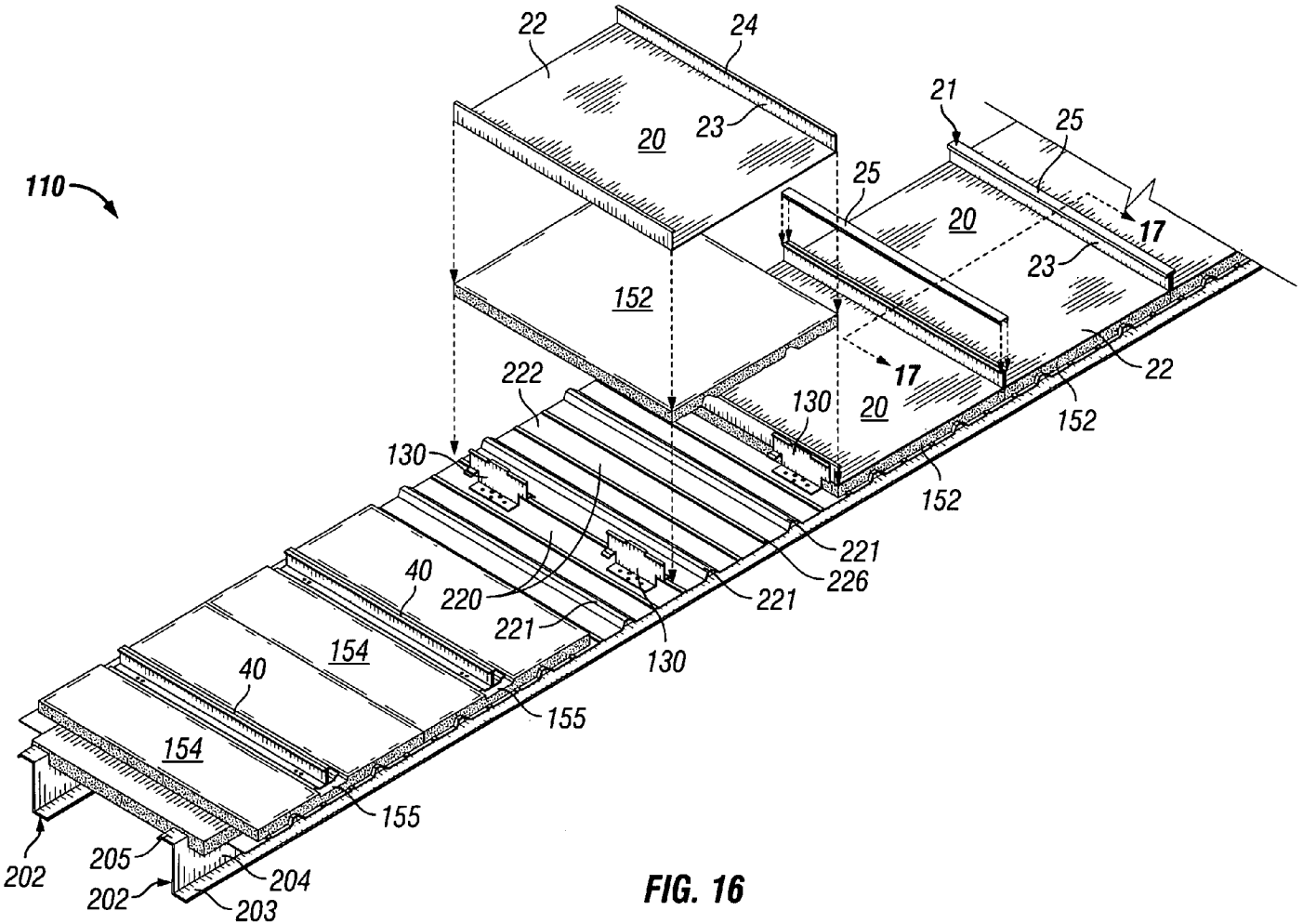
FIG. 16 is a perspective, partially exploded view of a portion of novel roof recover 110 taken generally from an area 16 of FIG. 15, which portion has been installed across a boundary between edge zone E and corner zone C of conventional roof cover 200 (certain components of novel roof recover 110 having been omitted therefrom)

Novel roof recover 110 in many respects is similar to novel roof 10. It generally comprises roof recover panels 20, individual clips 130, and continuous clips 40. Recover panels 20 are identical to panels 20 in novel roof 10, but will be referred to in this context as "recover" panels to distinguish them from panels 220 in existing roof 200. As shown in FIGS. 15-16, recover panels 20 run vertically and are interconnected along their lateral edges by standing seams 21. Standing seams 21 define troughs 22 through which water is shed from roof 110. The upper ends of recover panels 20, as seen in FIG. 15, extend under a ridge cap 111 provided along a peak line 112 of, roof 110. Preferably, each recover panel 20 runs down the entire slope of roof 110 to an eave or valley (not shown). Alternately, the troughs may be provided by two or more panels overlapped at their ends.

Figure 17:
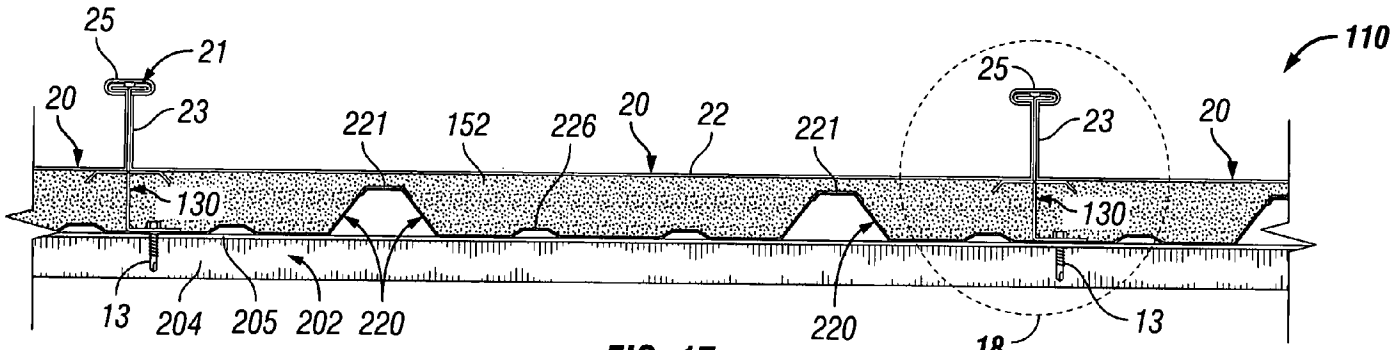
FIG. 17 is a cross-sectional view taken along line 17-17 of FIG. 16 of novel roof recover 110.

Panel clips are used to secure recover panels to an existing roof and to facilitate the formation of standing seams between the recover panels. Individual clips 130 and continuous clips 40, for example, are used to secure recover panels 20 over existing roof 200 and to facilitate the formation of seams 21 between adjacent panels 20 as shown in FIGS. 16-17. Individual clips 130 are disposed on the upper surface of existing panels 220 along the vertical seam lines between recover panels 20 and are attached by fasteners, such as screws 13, to purlins 202 in existing roof 200. If there is any sag in an existing metal roof 200, shim plates (not shown) may be provided under clips 130 so that they are aligned more or less in the same plane. Continuous clips 40 are disposed in grooves 155 on the upper surface of insulation boards 154, as discussed in greater detail below. In addition, various barrier sheets, films, and coatings may be provided over existing panels 220, if desired, to provide a vapor barrier, to reflect radiant heat, or to provide fire resistance.

Preferred embodiments of the subject invention include metal panel roof recovers in which individual panel clips are installed in the field of an existing roof and continuous clips are installed in corner zones, and where either individual or continuous clips are installed in edge zones of the existing roof. For example, similar to novel roof 10, individual panel clips 130 are installed in field zones F and edge zones E of novel roof recover 110 and continuous clips 40 are installed in corner zones C. That may be best appreciated by reference to FIG. 16, which is a section of novel roof recover 110 installed across a boundary between an edge zone E and a corner zone C.

As exemplified therein, individual clips 130 are mounted on panels 220 of existing roof 200 in linear arrays. The arrays of individual clips 130 run vertically through field zones F and edge zones E of existing roof 200 along what will become the seam lines for recover panels 20. Thus, the linear arrays of clips 130 are separated horizontally by a distance substantially equal to the width of recover panels 20.

Continuous clips 40 are installed in corner zones C of roof 200. Like individual clips 130, continuous clips 40 are mounted along the seam lines for recover panels 20 and thus are offset from each other by a distance approximately equal to the width of panels 20. In contrast to individual clips 130, however, continuous clips 40 are elongated and extend across adjacent purlins 202 in existing roof 200. Continuous clips 40, therefore, provide continuous support for panels 20 through corner zones C, thus providing greater resistance to wind uplift in those areas experiencing the greatest uplift forces. As with novel roof 10, the novel roof recovers may be provided with greater of fewer individual clips and continuous clips, and they may be provided in additional or different areas, so as to provide more or less resistance to wind uplift forces as may be required.

Figure 19:
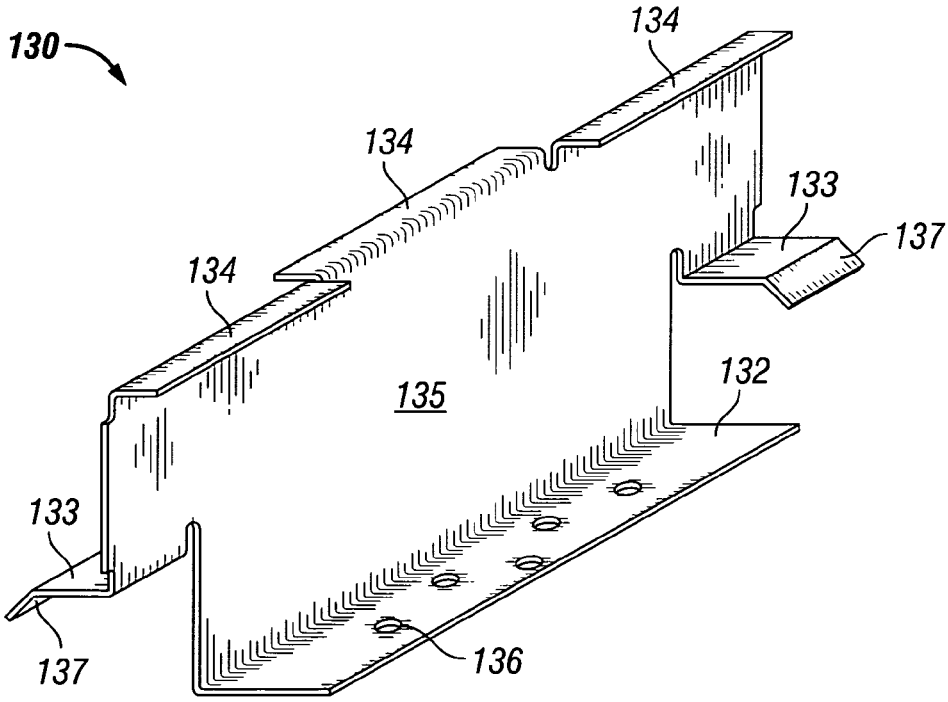
FIG. 19 is a perspective view of a preferred embodiment 130 of individual panel clips 130 used in novel roof recover 110 shown in FIGS. 15-18.

Continuous clips 40, seen best in FIG. 16, are identical to clips 40 used in novel roof 10. As may be seen from comparing FIGS. 5 and 19, individual clips 130 in novel roof recover 110 are quite similar in construction to individual clips 30 used in novel roof 10. Individual clips 130 include a bottom flange 132, shelf flanges 133, and top flanges 134 that extend generally horizontally from a vertically oriented web or body 135. Body 135 of clips 130, for reasons discussed below, is somewhat elongated relative to body 35 of clip 30. Bottom flange 132 provides a base by which clips 130 are attached to existing roof 200 by, for example, driving screws 13 through existing panels 220 into existing purlins 202. Round apertures 136 preferably are provided in base 132 to accommodate screws or other fasteners, but if desired, slots may be provided, or screws may be driven through base 132.

Shelf flanges 133 have a first more or less horizontal portion which, along with top flanges 134, provides support for recover panels 20. Top flanges 134 also facilitate the formation of standing seams 21 between recover panels 20. As recover panels 20 are installed, therefore, sides 23 of panels 20 will be supported on the top surfaces of shelf flanges 133 in adjacent lines of clips 130. At the same time, U-shaped channels 24 in the upper portion of sides 23 of panels 20 are slipped over top flanges 134. A seam cover 25 then is provided over and around the exterior of channels 24 to secure panels 20 to each other and to clips 130. Preferably, a sealant, such as a bead of silicone caulk or elastomeric tape, is provided between seam cover 25 and the exterior of channels 24 to enhance the weather tightness of seams 21. A seamer also may, and preferably is used to securely connect and seal seam cover 25 to panel sides 23.

Preferably, novel roof recover 110 allows for the installation of insulation between existing roof 200 and recover 110. Individual and continuous clips may be configured to mount over insulation, or they may be configured such that when recover panels are attached thereto space is created for the installation of insulation.

For example, when individual clips 130 are installed over existing roof 200, body 135 is sufficiently elongated that shelf flanges 133 are situated somewhat above lap ridges 221 in existing panels 220 and, necessarily, well above shorter vertical ridges 226. Thus, when recover panels 20 are attached to individual clips 130, a clearance or space is created between existing panels 220 and recover panels 20. The amount of space provided between the existing panels and recover panels and the choice of insulation may be coordinated to provide whatever level of thermal resistance for the cover that may be desired. When materials having higher thermal resistance are used, less space may be provided, and vice versa.

Any of the wide variety of insulating materials commonly used in building construction to reduce heat transfer by conduction, radiation, or convection may be used in the novel recover metal roofs. Such insulating materials include polyurethane, isocyanate, and other spray foam insulation, cotton, rock and slag wool, fiberglass, and other fibrous bats and blankets, cellulose and other blown-in fibrous insulation, and expanded or extruded closed cell polystyrene (EPS and XPS), polyisocyanate, and other rigid plastic foam insulation. Various barrier sheets, films, coatings, and facing also may be provided to provide additional thermal resistance, to minimize water condensation in the insulation, or to provide fire resistance to the insulation.

The choice of insulating materials will depend in large part on the degree of thermal resistance desired and cost considerations. At the same time, however, recover panels will be supported by panel clips only along their seams. Especially in the edge and corner zones, the panel clips provide relatively little support for the trough areas of the panels. Thus, insulation preferably is selected and installed so that it will provide support for the panels in their trough areas. That support preferably is sufficient to allow workers to walk over the recovered roof without causing the panels to sag to a degree that will make a worker uncomfortable or that will damage the seams between recover panels.

For example, in field zones F of recover roof 110 panels 20 are relatively resistant to sagging. Thus, a fiberglass blanket may be installed in the space between existing panels 220 and recover panels 20, for example, by rolling it between rows of clips 130. Alternately, slits may be provided in the blanket such that when it is laid over individual clips 130 they will extend through the blanket and allow panels 20 to be attached thereto. If desired, multiple layers of blankets may be laid crosswise (not shown). In any event, shelf flange 133 and, in particular, a downwardly angled extension 137 thereof may assist in holding down blankets, or any other insulation components used in the roof recover, as they are installed. Since blankets are easily compressed, they will conform to the dimensions and profile of the insulation space once recover panels 20 are attached to clips 130.

Figure 18:
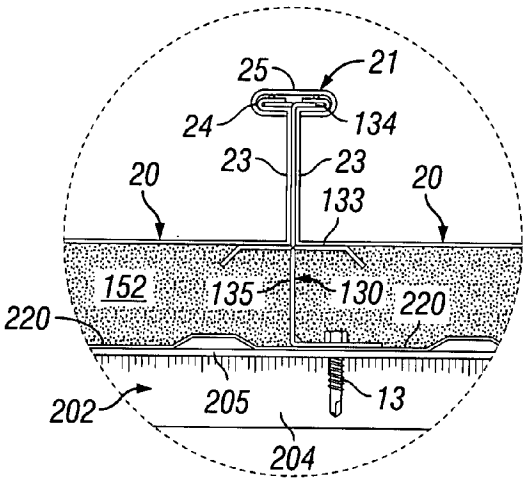
FIG. 18 is an enlarged, detailed view of portion 18 of the view shown in FIG. 17.

Edge zones E and especially corner zones C of recover roof 10, however, have relative low load capacity. In the absence of supporting insulation, workers walking on recover panels 20 may damage seams 21. Thus, rigid insulation, such as rigid plastic foam boards 152 are provided in the insulation spaces in the edge zones E and corner zones C as shown in FIG. 16. Foam boards 152, as may be seen in FIG. 16, have a generally flat, solid rectangular configuration such that they may be placed over existing panels 220 between adjacent rows of clips 130 with their sides closely abutting each other. The bottom surface of foam board 152 preferably is profiled to mate more or less with the profile of existing panel 220, as may be seen in the cross-section views of FIGS. 17-18. The bottom surface of foam boards 152, therefor, will be able to rest more or less continuously across the surface of existing panels 220, thus allowing any load transmitted to the foam to be distributed across a wider area. Cutouts may be provided (not shown), if desired, to accommodate individual clips 130 and facilitate installation of foam boards 152. Wider foam boards spanning across seam lines also may be provided with openings to accommodate individual panel clips.

Foam boards 152 preferably are composed of relatively dense high load capacity rigid plastic foam, such as expanded or extruded closed cell polystyrene. They may comprise facing, such as various barrier sheets, films, and coatings designed to provide a vapor barrier, to reflect radiant heat, or to provide fire resistance, or they may be unfaced. Preferably, foam boards will have a load capacity of at least about 25 pounds per square inch (psi). If desired, however, a somewhat less dense, lower load capacity foam may be used in edge zones E, such as a foam having a load capacity of a least about 18 psi. Less dense foam may provide sufficient support in edge zones E while reducing costs somewhat, the cost of such foam insulation being directly correlated to its density. On the other hand, foam boards also may be provided in all or part of field zones F of recover roof 10 if additional load capacity in those zones is desired.

While individual clips 130 are installed on panels 220 of existing roof 200, continuous clips 40 may be installed over foam boards, such as foam boards 154, which as may be seen in FIG. 16, are tiled over existing roof 200. Foam boards may be used to provide insulation and to support panel clips above the roof panels, yet still allow the panel clips for recover panels to be mounted to the existing purlins. Thus, other factors being equal, the panel clips may be made shorter than equivalent clips designed to be supported on existing roof panels. Moreover, especially in installations where the existing roof has surface irregularities, as are commonly present when the existing panels ride on top of a relatively thick layer of insulation, mounting individual clips on top of insulation boards allow them to be aligned more easily. Preferably, the insulation boards are configured to not only accommodate the upper profile of existing panels, but also to accommodate the lower profile of panel clips.

For example, as shown in FIG. 16, foam boards 154 have a generally flat, solid rectangular configuration. Thus, a plurality of foam boards 154 may be tiled on the surface of existing roof 200, or some portion thereof, with their sides closely abutting each other. The lower surface of foam board 154 is profiled to match the profile of existing roof panels 220. The upper surface of foam board 154 is provided with a groove 155 running the length of foam board 154. Groove 155 is configured to accommodate continuous clips 40. That is, as will be appreciated from FIGS. 20-21, the depth and width of groove 155 is such that shelf flanges 43 of continuous clips 40 will be substantially even with foam board 154 when continuous clips 40 are placed in grooves 155. Thus, recover panels 20 will be supported across substantially the same plane.

The precise dimensions of the grooves in the novel insulation boards, of course, will be coordinated with the particular panel clips to be employed. Thus, the groove may vary in depth and width, and in its profile as required to accommodate panel clips. It also will be appreciated that individual clips, though illustrated herein as being supported on panels in an existing roof, may be supported on and mounted to existing purlins through insulation boards. Bearing plates designed to distribute the load of individual clips across a foam board also may be employed.

Similarly, the length and width of the insulation boards may be varied as desired, but generally the width will be coordinated with the width of the recover panels to be installed. Typically, the width will be equal to the width of the recover panel or some multiple thereof. Foam board 154, for example, has a width equal to the width of recover panels 20. Moreover, it will be appreciated that any grooves or arrays of separate recesses preferably will be located to allow indexing of the insulation boards and panel clips as they are installed. For example, groove 155 runs along the centerline of foam boards 154. Thus, when foam boards 154 are tiled across existing roof 200, grooves 155 will be spaced apart at a distance substantially equal to the width of recover panels 20. Installation of panel clips 40 may proceed more efficiently, the need for measuring and marking installation lines having been obviated.

As is true for the clips used in original installations, such as novel roof 10, a variety of clips, both individual and continuous may be used in the novel recover roofs. The dimensions of the illustrated clips may be varied considerably, as may the materials from which they are fabricated. Likewise, they may be integral or multi-component clips, and various flanges and the like may be welded or otherwise affixed to a body. Additional details on preferred metal roof covers are described in applicant's co-pending application entitled "Metal Panel Roof Recover," U.S. Ser. No. 13/573,282, filed Sep. 7, 2012, the disclosure and drawings of which is incorporated herein in its entirety by this reference thereto.

The novel metal panel roof recovers also have been described in relation to metal roofs in general and to existing metal roof 200 in particular. It is to be understood, however, that the novel roof recovers may be installed over other types of existing roofs, such as rubber roofs, without departing from the principles of the present invention.

An existing roof may or may not have a skylight therein. If there is no skylight in the existing roof, an opening therein may be provided. If any existing skylight will not interfere with a recover or new skylight, it may be left in place. Otherwise, it will be removed. In any event, when a metal panel recover is being installed over an existing roof, one or more runs of recover panels may be omitted, either completely or partially, to create an opening in the recover that corresponds more or less to the skylight or opening in the existing roof.

For example, as will be appreciated from FIG. 15, a run of recover panels 20 has been partially omitted in four areas of roof 10 to provide openings in recover roof 110. Those openings correspond more or less to openings or skylights (not shown) in existing roof 200. Four novel skylight assemblies 160 are mounted over the openings in recover roof 110. As with skylights 60 in roof 10, skylights 160 run generally vertically across novel recover roof 110 from under ridge cap 11. They may run down the entire slope of recover roof 110 to an eave or valley or, as shown in FIG. 15, terminate short thereof. Similarly, they may be installed across an opening created by omitting a single run, as shown in FIG. 15, or across wider openings created, for example, by completely or partially omitting adjacent runs of panels.

Figure 20:
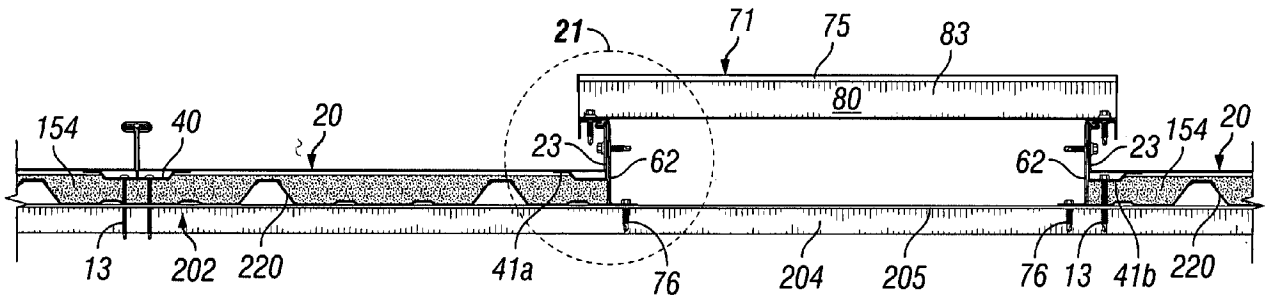
FIG. 20 is a cross-sectional view, similar to the cross-sectional view of novel roof 10 shown in FIG. 10, taken horizontally across a mid-portion of novel skylight 160 of roof recover 110.
Figure 21:
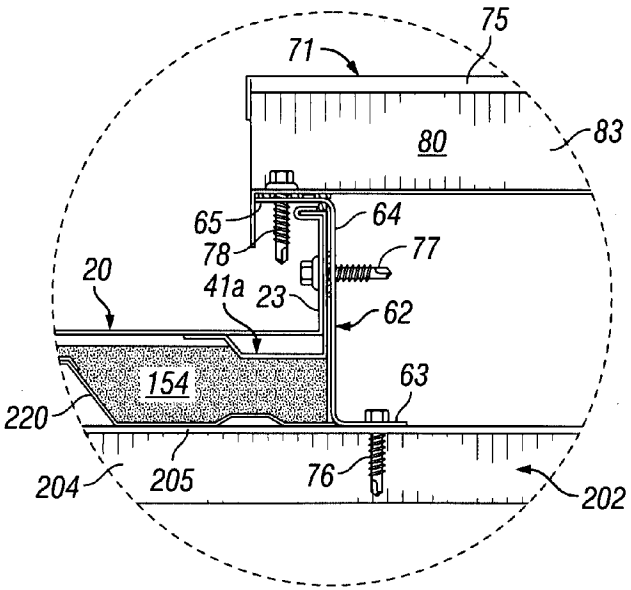
FIG. 21 is an enlarged, detail view of portion 21 of the view shown in FIG. 20.

The novel skylights 160, as will be appreciated from FIGS. 20-21, are quite similar in construction to skylights 60. They generally comprise an array of opaque panels 70 and translucent panels 80 mounted horizontally across vertically mounted struts 162. Struts 162, like struts 62, preferably are Z-shaped as shown in FIGS. 20-21. Because cover panels 20 in roof 110 are installed above insulation boards 152 and 154, however, body portion 164 of struts 162 are somewhat taller to allow upper flange 165 of struts 162 to extend over sides 23 of adjacent cover panels 20. In other respects skylights 160 are constructed, and may be installed in substantially the same manner as are skylights 60.

Struts 162 are shown as being mounted to purlins 202. In the event that skylight 162 extends a substantial distance beyond openings in existing roof 200, however, struts may be mounted on panels 220 of existing roof 200, in a fashion similar to individual panel clips 130, or over a insulation board, in a fashion similar to continuous panel clips 40. An angle support similar to angle support 67 also may be provided for additional support if desired.

While illustrated in the context of recover roof 110, the novel skylights may be used in other standing seam metal panel recover systems. They may be used in other standing seam metal panel recover systems similar to recover roof 110 which are disclosed in applicant's pending application, U.S. Ser. No. 13/573,282, filed Sep. 7, 2012, and entitled "Metal Panel Roof Recover," the disclosure of which is incorporated herein by reference. The novel skylights also may be installed with recover systems which utilize new purlins installed over existing roof panels, for example, by purlin clips attached to existing purlins. They also may be installed in recover systems which incorporate notched purlins, such as those disclosed in U.S. Pat. No. 5,367,848 to D. McConnohie, where the notches accommodate the seams and ridges in existing panels so that new purlins may be attached directly to existing purlins without clips. The novel skylights may even be installed with needlessly complicated recover systems, such as those disclosed in U.S. Pat. No. 8,061,087 to G. Ray, which require the installation of even more purlins above and between the purlins in an existing roof at considerable extra cost with little, if any, added benefit as compared to better systems. Thus, it will be appreciated the novel skylights may be installed in a wide variety of recover systems, but more importantly, that they are equally suited for new installations and for recover installations.

While this invention has been disclosed and discussed primarily in terms of specific embodiments thereof, it is not intended to be limited thereto. Other modifications and embodiments will be apparent to the worker in the art.

What is claimed is:

1. A roof having a skylight, said roof comprising:

(a) a cover having a pitch;

(b) a pair of elongated struts mounted on opposing sides of an opening in said roof cover, said struts running generally along said pitch of said roof cover;

(c) a translucent panel mounted across said struts, said translucent panel having upwardly extending sides that define a trough between said sides, said trough adapted to collect and shed water from said panel between said sides, said sides running generally across said pitch of said cover, (d) a second panel having an upwardly extending side, said second panel being disposed beside said translucent panel such that said side of said second panel faces a said side of said translucent panel;

(e) wherein said side of said second panel and said facing side of said translucent panel are connected to form a seam between said translucent panel and said second panel, said seam being elevated above said trough and running generally across said pitch of said cover;

(f) wherein said struts are adapted to support said translucent panel above said roof cover such that water from said trough of said translucent panel is shed onto said cover.

2. The roof of claim 1, wherein the ends of said translucent panel extend over said roof cover.

3. The roofs of claim 1, wherein said struts are "Z" struts.

4. The roof of claim 3, wherein said struts have a horizontally extending support flange and said translucent panel is mounted on said support flanges.

5. The roof of claim 4, wherein said support flanges on said struts extend horizontally beyond said opposing sides of said opening and terminate over said roof cover.

6. The roof of claim 4, wherein said translucent panel is mounted at the ends thereof to said strut support flanges proximate to the ends of said trough by penetrating fasteners, said penetrating fasteners being installed through a portion of said flange extending over said roof cover.

7. The roof of claim 1, wherein said roof comprises two said translucent panels disposed beside each other such that a said side of one said translucent panel faces a said side of said other translucent panel, wherein said facing translucent panel sides are connected by a seam, said seam being elevated above said trough and running generally across said pitch of said roof.

8. The roof of claim 7, wherein said faring sides of said translucent panels are connected by a seam cover.

9. The roof of claim 1, wherein said second panel is a metal panel.

10. The roof of claim 1, wherein said translucent panel is mounted to said struts proximate to the ends of said trough.

11. The roof of claim 10, wherein said side of said second panel and said facing side of said translucent panel are connected by a seam cover.

12. The roof of claim 1, wherein said side of said second panel side and said facing side of said translucent panel are connected by a seam cover.

13. The roof of claim 1, wherein said roof comprises first and second elongated bearing plates and said first and second struts are attached, respectively, to said first and second elongated bearing plates.

14. A metal panel roof system having a skylight comprising:

(a) a support frame having a pitch and including an array of spaced purlins running through said support frame generally across said pitch;

(b) a plurality of metal panels providing an outer cover for said roof system, said cover panels being mounted across said array of purlins and generally along said pitch, said cover panels having upwardly extending sides that define a trough between said sides, said sides of said cover panels being connected to form seams between said cover panels, said seams running generally along said pitch;

(c) an open space between a first one of said cover panels and a second one of said cover panels, said first and second cover panels being horizontally spaced from each other; and (d) a plurality of said skylight panels mounted side by side over said open space, each said skylight panel having upwardly extending sides that define a trough between said sides, said trough adapted to collect and shed water from said skylight panel between said sides of said skylight panel, said sides of said skylight panel running generally across said pitch;

(e) wherein facing said sides of adjacent said skylight panels are connected to form a seam between said adjacent skylight panels, said seam being elevated above said trough and running generally across said pitch; and (f) wherein at least one of said skylight panels is a translucent panel.

15. The roof system of claim 14, wherein the ends of said translucent skylight panels extend over said roof cover.

16. The roof system of claim 14, wherein said system comprises:

(a) a first elongated strut mounted across purlins in said array proximate to said first cover panel; and (b) a second elongated strut mounted across said purlins proximate to said second cover panel;

(c) said first and second struts each having a support flange extending horizontally from said strut, said support flanges extending above said first and second cover panels;

(d) wherein said translucent panels are mounted on said support flanges.

17. The roof system of claim 16, wherein said struts are "Z" struts.

18. The roof system of claim 16, wherein said system comprises first and second elongated bearing plates mounted across said purlins and said first and second struts are attached, respectively, to said first and second elongated bearing plates.

19. The roof system of claim 16, wherein said support flanges on said struts extend horizontally beyond said sides of said first and second cover panels that are proximate to said opening and terminate over said troughs of said first and second cover panels.

20. The roof system of claim 16, wherein said translucent skylight panels are mounted at the ends thereof to said strut support flanges by penetrating fasteners, said penetrating fasteners being installed through a portion of said flange extending over said troughs in a said first and second cover panels.

21. The roof system of claim 14, wherein said translucent skylight panel sides are symmetrical.

22. The roof system of claim 14, wherein at least two of said skylight panels are translucent.

23. The roof system of claim 14, wherein said facing said sides of adjacent said skylight panels are connected by a seam cover.

24. A method of installing a skylight in a roof cover having a pitch, said method comprising:

(a) providing an opening in said roof cover;

(b) providing a translucent panel having upwardly extending sides that define a trough between said sides, said sides of said translucent panel being, adapted to form a seam with a second panel having an upwardly extending side (c) installing said translucent panel over said opening such that said sides of said translucent panel run generally across said pitch of said roof cover and said translucent, panel sheds water from said trough onto said roof covers;

(d) installing said second panel beside said translucent panel such that said second panel side faces a said side of said translucent panel; and (e) connecting said side of said second panel to said facing side of said translucent panel to form a seam between said translucent panel and said second panel, said seam being elevated above said trough and running generally across said pitch of said roof cover.

25. The method of claim 24, wherein said side of said second panel and said facing side of said translucent panel are connected by a seam cover.

26. The method of claim 24, wherein said translucent panel is installed over said opening such that the ends of said translucent panel extend over said roof cover.

27. The method of claim 26, wherein said method comprises installing a second said translucent panel next to said translucent panel such that a said side of one said translucent panel faces a said side of said other translucent panel, wherein said facing translucent panel sides are connected by a seam, said seam being elevated above said trough and running generally across said pitch of said roof.

28. The method of claim 27, wherein said facing sides of said translucent panels are connected by a seam cover.

29. The method of claim 24, wherein said method comprises installing a pair of elongated struts on opposing sides of said opening in said roof cover, said struts running generally along said pitch of said roof cover, and said translucent panel and said second panel are installed on said struts.

30. The method of claim 29, wherein said struts are "Z" struts.

31. The method of claim 30, wherein said struts have a horizontally extending support flange and said translucent panel is mounted on said support flanges.

32. The method of claim 31, wherein said support flanges on said struts extend horizontally beyond said opposing sides of said opening and terminate over said roof cover.

33. The method of claim 32, wherein said translucent panel is mounted at the ends thereof to said strut support flanges proximate to the ends of said trough by penetrating fasteners, said penetrating fasteners being installed through a portion of said flange extending over said roof cover.

34. The method of claim 24, said method comprises installing a second said translucent panel next to said translucent panel such that a said side of one said translucent panel faces a said side of said other translucent panel, wherein said facing translucent panel sides are connected by a seam, said seam being elevated above said trough and running generally across said pitch of said roof.

35. The method of claim 24, where said facing sides of said translucent panels are connected by a seam cover.

* * * * *